US005709603A

United States Patent [19]

Kaye

[11] Patent Number: 5,709,603

[45] Date of Patent: Jan. 20, 1998

[54] PERSONAL COMPUTER LOTTERY GAME

[76] Inventor: Perry Kaye, 12696 Northwest 11th Ct., Sunrise, Fla. 33323

[21] Appl. No.: 738,317

[22] Filed: Oct. 25, 1996

Related U.S. Application Data

[63] Continuation-in-part of Ser. No. 418,011, Apr. 6, 1995, Pat. No. 5,569,082.

[51] Int. Cl.[6] ..... A63F 1/00; A63B 71/00

[52] U.S. Cl. ..... 463/17; 463/10; 463/42; 273/138.2

[58] Field of Search ..... 463/1, 16–19, 463/30–31, 9, 40–42, 10–13; 273/139, 138.1, 138.2; 364/410.1, 411.1, 412.1

[56] References Cited

U.S. PATENT DOCUMENTS

| | | | |
|---|---|---|---|
| 3,594,004 | 7/1971 | Barr | 273/139 |
| 4,108,361 | 8/1978 | Krause | 364/412 |
| 4,288,077 | 9/1981 | Rose et al. | 273/138 R |
| 4,575,622 | 3/1986 | Pellegrini | 364/410 |
| 4,582,324 | 4/1986 | Koza et al. | 273/138 A |
| 4,652,998 | 3/1987 | Koza et al. | 364/412 |
| 4,689,742 | 8/1987 | Troy et al. | 273/138 A |
| 4,760,247 | 7/1988 | Keane et al. | 364/412 |
| 4,764,666 | 8/1988 | Bergeron | 273/139 |
| 4,832,341 | 5/1989 | Muller et al. | 273/138 A |
| 4,882,473 | 11/1989 | Bergeron et al. | 235/380 |
| 4,996,705 | 2/1991 | Entenmann | 364/412 |
| 5,069,453 | 12/1991 | Koza et al. | 273/139 |
| 5,083,272 | 1/1992 | Walker et al. | 364/412 |
| 5,088,737 | 2/1992 | Frank et al. | 273/139 |
| 5,112,050 | 5/1992 | Koza et al. | 273/139 |
| 5,116,049 | 5/1992 | Sludikoff et al. | 273/139 |
| 5,158,293 | 10/1992 | Mullins | 273/139 |
| 5,176,380 | 1/1993 | Evans et al. | 463/16 |
| 5,186,463 | 2/1993 | Marin et al. | 463/17 |
| 5,212,368 | 5/1993 | Hara | 235/375 |
| 5,223,698 | 6/1993 | Kapur | 364/412 |
| 5,282,620 | 2/1994 | Keesee | 273/138 A |
| 5,326,104 | 7/1994 | Pease et al. | 273/138 A |
| 5,327,485 | 7/1994 | Leaden | 379/95 |
| 5,330,185 | 7/1994 | Wells | 364/412 |
| 5,331,141 | 7/1994 | Kaneko | 235/462 |
| 5,342,047 | 8/1994 | Heidel et al. | 273/138 A |
| 5,348,299 | 9/1994 | Clapper, Jr. | 273/138 A |
| 5,362,051 | 11/1994 | Swafford, Jr. et al. | 463/16 |
| 5,365,575 | 11/1994 | Katz | 379/92 |
| 5,373,440 | 12/1994 | Cohen et al. | 364/410 |
| 5,377,975 | 1/1995 | Clapper, Jr. | 273/138 A |
| 5,398,932 | 3/1995 | Eberhardt et al. | 273/138 A |
| 5,407,199 | 4/1995 | Gumina | 273/138 R |
| 5,411,258 | 5/1995 | Wilson et al. | 364/410 |
| 5,415,416 | 5/1995 | Seagnelli et al. | 273/138 A |
| 5,417,424 | 5/1995 | Snowden et al. | 364/412 |
| 5,429,361 | 7/1995 | Raven et al. | 273/138 A |
| 5,472,196 | 12/1995 | Rusnak | 463/16 |
| 5,569,082 | 10/1996 | Kaye | 463/17 |
| 5,580,311 | 12/1996 | Haste, III | 463/16 |

FOREIGN PATENT DOCUMENTS

| | | | |
|---|---|---|---|
| WO 91/06931 | 5/1991 | WIPO | 17/32 |
| WO 94/03873 | 2/1994 | WIPO . | |

*Primary Examiner*—Jessica Harrison
*Assistant Examiner*—Mark A. Sager
*Attorney, Agent, or Firm*—Martin Korn

[57] ABSTRACT

A method and system for playing a lottery type game includes a gaming piece which includes a predetermined code having data indicating whether the player wins or loses the game, the data being unrecognizable to the player, such that the player does not know the outcome of the game prior to play of the game. The code is stored on the gaming piece in a memory device. The gaming piece is reusable with different codes. The code is read by a processor. The processor presents an amusement game on a display for play by the player, and the player controls game play by inputting game parameters to the processor. The processor controls the outcome of the amusement game played by the player based upon the code. A display provides an indication to the player of a game win or a game loss based upon the code.

17 Claims, 16 Drawing Sheets

PERSONAL COMPUTER LOTTERY GAME

RELATED APPLICATION

The present application is a continuation-in-part application of U.S. Ser. No. 08/418,011, filed Apr. 6, 1995, entitled "Personal Computer Lottery Game", and now U.S. Pat. No. 5,569,082.

TECHNICAL FIELD OF THE INVENTION

The present invention relates to personal computers, and more particularly to a lottery/casino type game which allows players to purchase gaming pieces including a data storage media to be used for game play.

BACKGROUND OF THE INVENTION

The present invention relates to a method and system for the administrating, operating, and playing of a game in which a player acquires a chance to win and the outcome of that chance is displayed in an interesting, fun, and exciting fashion.

An important application of the invention is in the operating of games of chance in which a person purchases a chance to win and then learns of the outcome in an interesting and fun fashion. Some of these games are usually called lotteries or raffles. The operation and running of these games entails the purchase of a chance to win and then at some point a single and usually quick action displays the outcome of the game.

As an example, the playing of what is called a scratch off lottery is as follows. A player purchases a chance to win in the form of a card having symbols and a covered area that conceals the outcome of the game. In this type of game the odds of winning are controlled by the number and type of cards that are created. The player scratches the coating that covers the concealed area which reveals the game's outcome by the symbols or words that are under the coating. This activity provides the player with just a brief few moments of excitement.

Problems are inherent in the current gaming systems arising from: (a) the low level of excitement that is generated from the display of the game's outcome; (b) the fact that it takes just a few moments to play the game; (c) insufficient player interaction with the game except for boring scratching of the coating; (d) excessive space that is required to store the different games necessary to stock all of the available printed game cards; (e) tracking and control of the game cards; (f) non-challenging simple games; (g) dirt caused by the scratched coating; (h) the limited number of games because the only variations to the game are the use of different symbols, colors, or placement of the symbols; (i) fraud caused by game card theft and/or tampering; (i) waste caused by the need to print and stock many different game cards to keep players interested; (k) restricting access to minors; and (l) allowing for system wide and regional control and monitoring.

There are many ways in which these problems are overcome by the present invention and there are many new ways to apply this invention to create new and exciting games.

Players want a game that has variety, excitement, a multi-sensory game display, which provides players with options and choices. Game operators want a game that has controllable odds, is simple to run and administer, will increase their sales, help eliminate fraud, and control their inventory.

Bearing these facts in mind it is considered that any improved design of such a game should incorporate the principle of allowing a player to acquire at least one chance to win, in a game of chance, and then provide an exciting and interesting display for the outcome of that chance. The display method would be even more interesting if it were player selectable and if many companies could participate in the creation of the games that display the outcome.

A need has thus arisen for a system for administrating and operating a game that overcomes some of the problems associated with known systems.

SUMMARY OF THE INVENTION

In accordance with the present invention, a method and system for playing a lottery type game is provided. The player acquires a gaming piece which includes a predetermined code having data indicating whether the player wins or loses the game, the data being unrecognizable to the player, such that the player does not know the outcome of the game prior to play of the game. The predetermined code is stored on the gaming piece in a memory device. The gaming piece is reusable with different codes. The code is read by a processor. The processor presents an amusement game to the player on a display for play by the player, and the player controls game play by inputting game parameters to the processor. The processor controls the outcome of the game played by the player based upon the predetermined code. A display provides an indication to the player of a game win or a game loss based upon the predetermined code.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
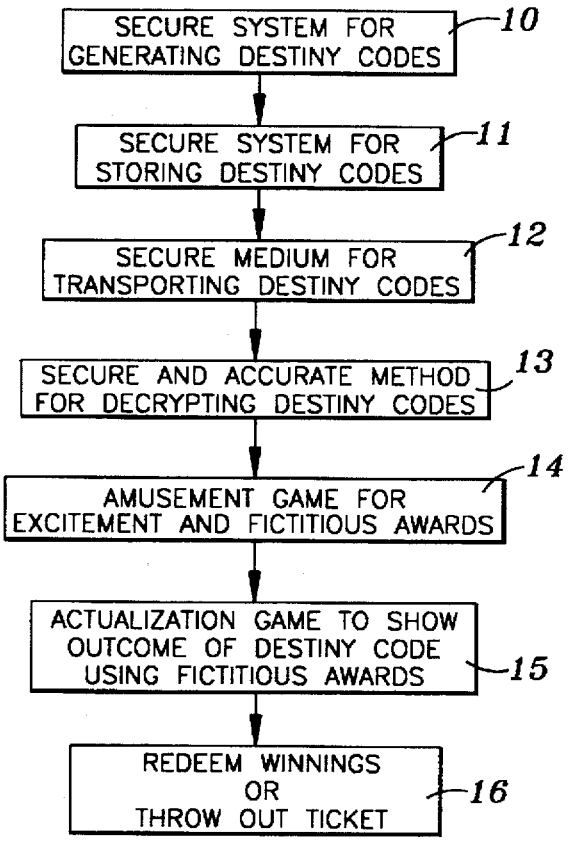
FIG. 1 is a block diagram of the basic components of the present game.

FIG. 1 is a block diagram of the basic components of the present system. Block 10 shows that the start of the system requires a secure system for generating, controlling and tracking encrypted symbolic codes that signify the outcome of the particular game of chance played by the player. These codes are called "Destiny Codes" because their primary function is to store the outcome of the game of chance. The codes can, in addition, store other data that assists in the playing of the game, the tracking of the game, the security of the game, or any other data that may enhance the play of the game. If the player knew the procedure to decode the Destiny Code, the player would be able to determine if the Destiny Code contained a winning chance or a losing chance. The total and actual result of the game is encoded in the Destiny Code. By decoding the Destiny Code one reveals whether or not a game was a winner or a loser, and if it was a winner, the prize won.

The system for generating the Destiny Codes stores the codes on a secure medium called the Game Medium. The process of storing the Destiny Codes on the Game Medium is identified in block 11, and the Game Medium is signified in block 12. The process of storing the Destiny Codes on the Game Medium depends on the type of Game Medium used. If, for example, the Game Medium is paper, then the storing of the Destiny Codes is through printing. If the Game Medium is a computer, then the storage of the Destiny Codes includes magnetic or laser techniques. The Game Medium allows for the storing of several Destiny Codes. Security can be added to provide a deterrent to theft and fraud.

As used herein, the terms "Game Medium", "game media" and "gaming piece" include, but are not limited to, a paper ticket, or a token or a casino chip simulating a coin. Characteristic of all gaming pieces utilized with the present invention are that the piece includes the Destiny Codes stored thereon, either by printing, magnetics, or an integrated circuit memory device.

Once a Destiny Code is generated and stored, a player can acquire that Destiny Code and use the code in the play of a game. Because the Destiny Code stores the actual outcome of the game, the code must be processed to discover how the game should play. Block 13 indicates the step of decrypting and decoding of a Destiny Code.

Using the code, a player is now allowed to play an amusement game signified by block 14. The game can be a completely random game where the player achieves points or awards. The game is purely for player enjoyment, and is used to give the feel of a completely random game of chance. One example of the game is a horse race in which the player is given a predetermined number of dollars to bet. At some point, either at the discretion of the player or the necessity of the game (all races have been run or the player has run out of money), the amusement game comes to an end.

The system now begins the playing of the actual game which is shown in block 15. The purpose of the actual game is to display, in a pleasing fashion, the actual prize that is stored in the Destiny Code and to display the game results as though there is a completely random element. One example of how the actual game interfaces with the horse race game is as follows. In this example the actual game is a lottery. The player could use the winnings from the horse race game to purchase fictitious lottery tickets. The player can have the computer select the tickets or the player can select the tickets. If the player is out of money the system will award one lottery ticket to the player.

At this point the actualization game determines the outcome of this game by using the Destiny Code. If the Destiny Code indicates the player is to win $25.00, then the system will select and display numbers that match the player's fictitious lottery ticket in a combination that wins the person $25.00. If the Destiny Code indicates that the player is to lose, then the system will select and display numbers that do not match the players fictitious lottery ticket so the player will view a losing game.

For example, assume the actual game requires three numbers to match to win $25.00, and the player has two lottery tickets. The first ticket contains the numbers 1, 2, 3, 4, 5, 6 and the second contains the numbers 20, 21, 22, 23, 24, 25. If the Destiny Code states that the player should win $25.00, the actualization game will select a set of numbers that make the player win the $25.00 actual prize. The actualization game displays, in a pleasing and seemingly random fashion, numbers being picked. The winning lottery numbers 21, 30, 6, 23, 24, 4 match three numbers from the second lottery ticket (21, 23, 24) and not enough numbers (you must have at least 3 to win) from the first ticket to cause the first ticket to win.

If the Destiny Code indicates that the player should not win, then the actualization game will select a set of numbers that do not create a winning combination from any of the lottery tickets, for example, the numbers 1, 2, 20, 21, 50, 60, or 51, 52, 53, 54, 55, 0.

The games of block 14 and block 15 can be run as one system, such as a poker game. The amusement/actualization game receives the Destiny Code which then sets up the game as a win or lose. The system displays a deck of cards and a display key that shows the jackpots and winning rules. The key could illustrate 1 Pair=$10.00, 3 Of A Kind=$15.00, 2 Pair=$20.00, a Straight=$50.00 and a Royal Flush=$100.00. The system shows five cards to the player, for example, a 10, Jack, 4, 6, and an 8. The player discards the 4, 6, 8 and the system, depending on the Destiny Code, will display cards that provide a winning and losing hand. If the code indicates the player is to win $10.00, cards 10, 2, and 4 may be dealt, so the player will have 10, 10, Jack, 2, 4. Two tens, 1 Pair, win $10.00. The rules of the game will be set up in such a way so the Destiny Code can have full control and freedom to display the actual outcome of the game.

If the above example was destined to be a loser then cards such as 2, 3, 4 could have been dealt.

Block 16 indicates redeeming the winnings. A player brings the Game Medium to a redemption and verification system in order to verify the validity of the Game Medium and the Destiny Code and receive payout of the game winnings, if the player has won, or learn that the player has lost the game.

Figure 2:
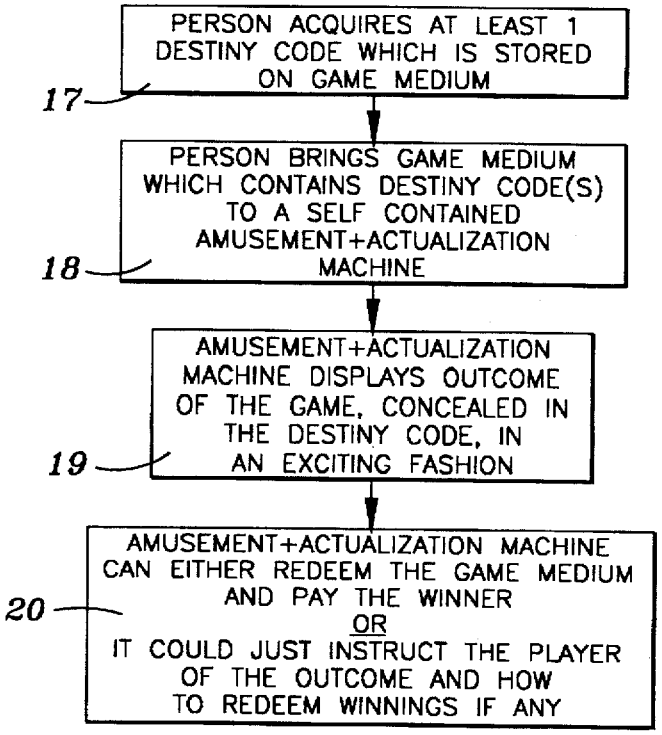
FIG. 2 is a block diagram of the basic steps of the self-contained embodiment of the present game.

FIG. 2 is a block diagram of the basic components of the Self-Contained Amusement/Actualization embodiment of the present game. This system allows a player to acquire a Game Medium with at least one Destiny Code in order for a player to play an exciting game and discover the outcome of the game without human intervention.

Block 17 signifies the acquisition of a Game Medium. Acquisition can be in any form, for example, a purchase from a salesperson or an Automated Destiny Code Machine shown in FIG. 4. The Game Medium includes one or more stored Destiny Codes.

A player wishing to purchase Destiny Codes reads the instructions on the instruction touch screen 33 of a sales device (FIG. 4) and enters answers to questions such as "how many tickets do you want to buy?" Money is put into a bill validator 34. A Game Medium reader/writer 35 creates a new Game Medium or adds new Destiny Codes to an existing Game Medium. The sales device can have predetermined Destiny Codes stored in it or it could be connected on-line and act as a Destiny Code terminal similar to a bank ATM. This allows many sales devices (FIG. 4) to give Destiny Codes under the control of a single organization and through a single computer or network.

Figure 5:
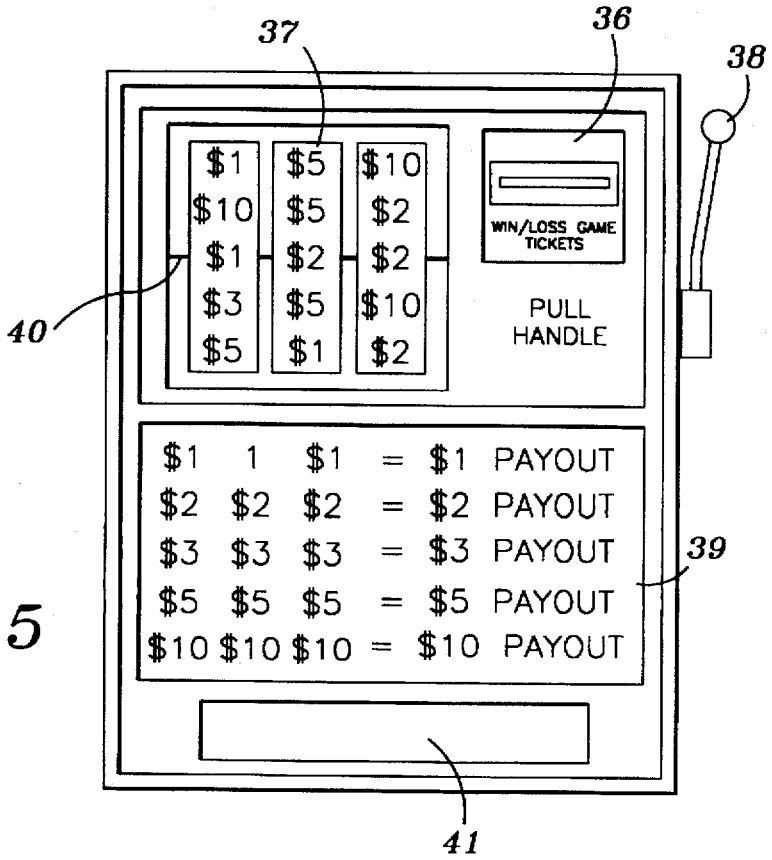
FIG. 5 illustrates a display device for the self-contained embodiment of the present game.

Players bring the Game Medium, in block 18 (FIG. 2), to a self-contained amusement+actualization device shown in FIG. 5 and allows the Game Medium reader/writer 36 to read the Destiny Codes from the Game Medium. The self-contained amusement+actualization device then reads in any order or in a sequential fashion the Destiny Codes. If a Destiny Code has not been used, the device will allow the person to play the game to discover the outcome concealed in the Destiny Code. FIG. 5 illustrates a slot type machine.

At block 19 (FIG. 2) the player pulls the handle 38 (FIG. 5), and the reels on the screen 37 spin and stop in an order that shows the outcome indicated by the Destiny Code. FIG. 5 illustrates display 37 displaying a losing combination, $1, $2, $2, on pay line 40. The key that shows which combinations are valid winners is displayed on the Game Instructions Screen 39. Screen 39 is a programmable screen that allows for the playing of any Destiny Codes possible winning combinations. FIG. 5 illustrates screen 39 for a game in which the maximum Actual Prize is $10.00 as controlled by the Destiny Code. If the Destiny Code indicated that the actual prize might be as great at $1,000.00, the game instructions screen would dynamically display this information.

Now that the game has been played and a Destiny Code has been decrypted and decoded, the Game Medium is marked by the Game Medium reader/writer 36 (FIG. 5) to show that particular Destiny Code has been played. If the player won at block 20, the self-contained amusement+actualization device can either pay out the prize through the pay out slot 41 (FIG. 5) or the device will instruct the player of the outcome or redemption instructions on the game instruction screen 39. The Game Medium reader/writer 36 marks the Game Medium to show that card contains a winner or a loser and that the Destiny Code has been used.

Figure 4:
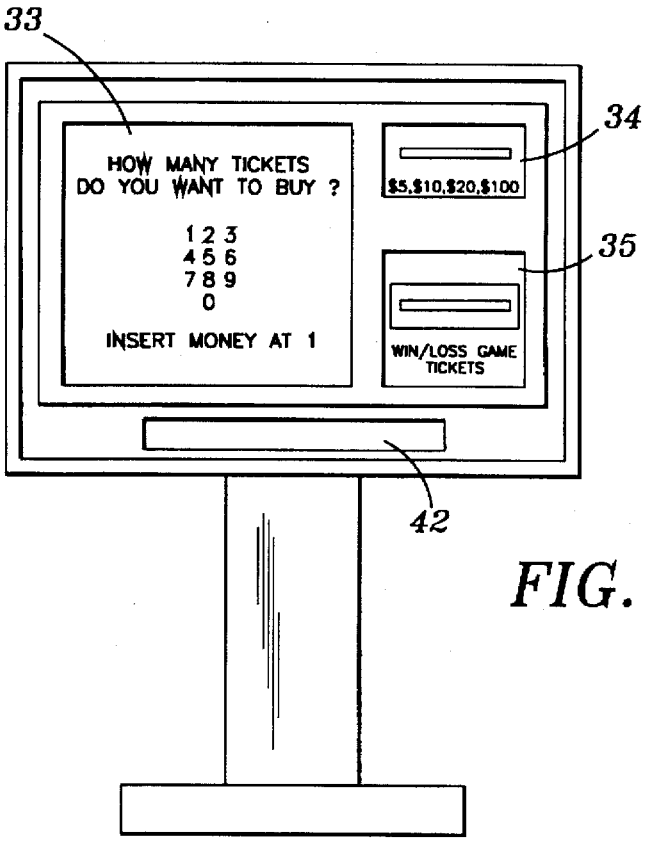
FIG. 4 illustrates a sales device used to purchase game media for the self-contained embodiment of the present game.

Redemption can also be accomplished at the automated Destiny Code machine, FIG. 4. A player allows the automated Destiny Code device (FIG. 4) to read the Game Medium at the Game Medium reader/writer 35. The instruction screen 33 will display instructions and information about the Game Medium and the stored Destiny Codes. Pay out can be received at the pay out slot 42.

Figure 3:
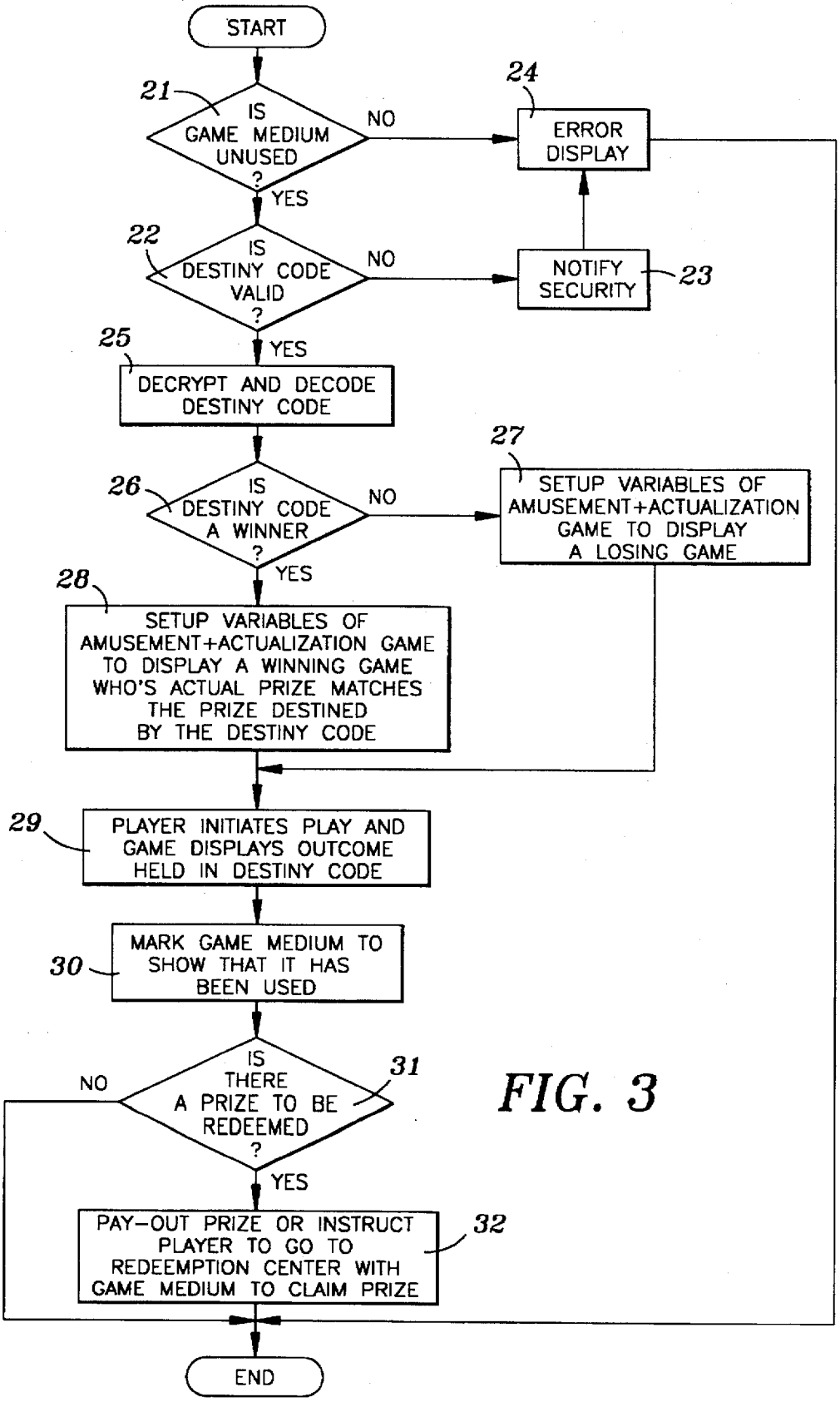
FIG. 3 is a computer flow chart illustrating operation of the self-contained embodiment of the present game.

Referring to FIG. 3, the self-contained amusement+actualization device program operates as follows. The system reads the Game Medium and checks to see if the Game Medium has been used at block 21. If the medium has been used, the amusement+actualization device displays an error at display 24 and exits. If the Game Medium has not been used, the program checks to see if the Destiny Code is valid at block 22. If the code is invalid, that is, there is evidence of tampering or fraud, the amusement+actualization device will notify security at block 23, display an error at display 24, and then exit.

If the Destiny code is valid at block 22 then the amusement+actualization device will decrypt the Destiny Code and decode the Destiny Code at block 25. This operation makes the Destiny Code readable. A determination is made at block 26 to see whether the Destiny Code indicates a win or loss.

If the Destiny Code is a loser, then the system sets the variables of the game so that the game will display a losing outcome at block 27. If the Destiny Code is a winner, then the system sets the variables of the game so that the game will display a winning outcome at block 28.

Player initiates play at block 29 and then the outcome of the Destiny Code is shown on the amusement+actualization display screen 37 (FIG. 5).

The Game Medium is marked at block 30 to show that particular Destiny Code has been used.

If there is an Actual Prize to be redeemed at block 31, the system at block 32 either pays out the prize or instructs the player to take the Game Medium to a redemption location.

Figure 6:
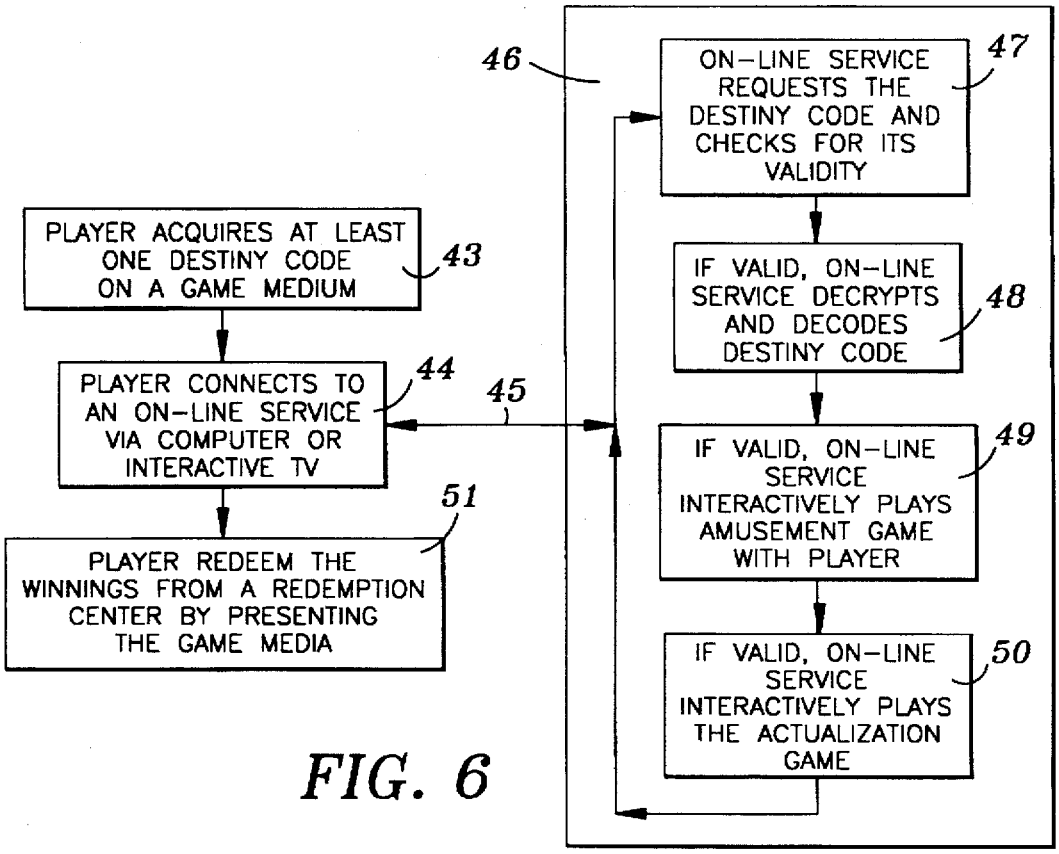
FIG. 6 illustrates a block diagram of the on-line embodiment of the present game.

FIG. 6 illustrates the on-line embodiment of the present game. The player acquires at least one Destiny Code on a Game Medium at block 43. The player brings the Game Medium to a home computer or an interactive TV system or some type of on-line service device at block 44 called the player's terminal. A connection is made at block 45 between the player's terminal 44 and the on-line system block 46.

The on-line system 46 controls a game as shown in FIGS. 8–13. Block 46 indicates the basic components necessary for the implementation of the on-line use. The on-line system will request the player's Destiny Code at block 47 and then will check the Destiny Code for its validity.

If the Destiny Code is valid and un-played, the on-line service will decrypt and decode the Destiny Code at block 48.

The on-line service now interactively plays an amusement game with the player at block 49. The player is awarded Fictitious Awards and plays until the player wishes to play the actualization game or until the game's rules require.

The on-line service now interactively plays an actualization game with the Player at block 50. The actualization game uses the fictitious awards in a way that gives the appearance that the awards have a value in the actualization game. The actualization game then displays in some interesting and exciting fashion the game's outcome that was concealed in the Destiny Code. The on-line system can store Destiny Codes and not allow the codes to be played twice.

The Player will now take the Game Medium to a redemption center and claim the actual prize, if any, at block 51.

Figure 7:
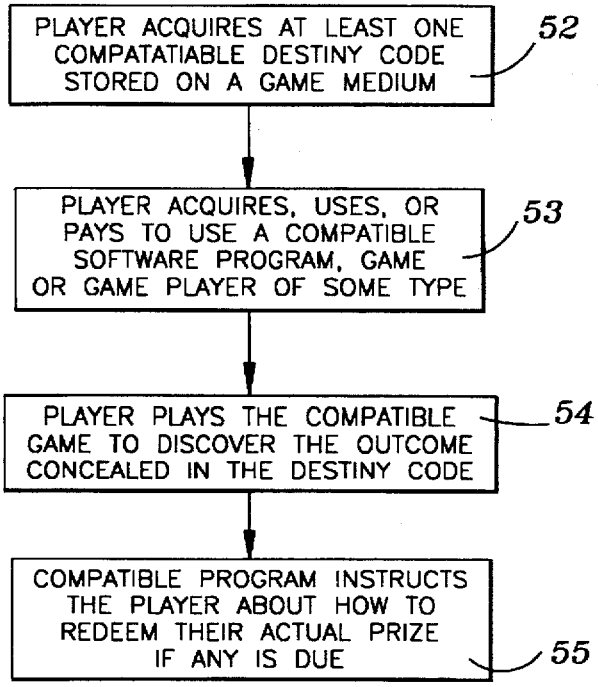
FIG. 7 illustrates a block diagram of a compatible system for use with the present game.

Referring to FIG. 7, a block diagram of a further embodiment of the present system is illustrated. Players acquire at least one Destiny Code that is made compatible with the present software, and is stored on a Game Medium at block 52.

The player now acquires a compatible game at block 53. Any compatible game will be able to determine the outcome of any compatible Destiny Code. Since only the outcome of the game is stored in the Destiny Code, and not the way in which the game should be played or its rules, many different types of compatible games will be developed to appeal to many different likes and interests.

Playing the compatible game allows the player to discover the outcome of the compatible Destiny Code at block 54.

The compatible game will then instruct the player about how to claim the actual prize, if any is due, at block 55.

Referring to FIGS. 8–13, software flow charts are illustrated for the present game. The program begins at the start block 110 where the player starts the program. The program will run as a stair computer program. The program is loaded into memory, and will set up program variables and display a "welcome" screen.

The system will request at least one Destiny Code from the player at block 112. In order for the player to access this program, the player will be required to enter a Destiny Code. This Destiny Code is stored in a separate location. The Destiny Code, for example, can be located on a plastic piece that is attached to the floppy diskette or CD ROM which stores the program. The plastic piece, in order for the disk to be used, must be broken off. Once the plastic piece is broken off, the piece can be opened like a book to reveal the Destiny Code.

The Destiny Code includes encoded control information for security purposes, such as, for example, manufacturer's code, lot number, game type, version number of the game and information. Program information includes whether the program is a winner or a loser; the amount of money that the program wins; the minimum prize for this game; the maximum prize for this game; and related game details. This Destiny Code will be the actual number that can be entered at a redemption site to indicate whether or not the Game Medium contains a winning game, independent of whether or not the game is played. The Destiny Code is the control number that is kept separate and physically off the disk.

At block 112, the Destiny Code is requested. There will be a check at block 114 to see if that Destiny Code is valid. If there is a missing number, or if the number is not within the range of valid numbers, then the program will go back and request the number again. This loop can be expanded by adding a feature that after a certain number of entries of the Destiny Code the diskette is wiped clean so that if a player is just trying to find out which Destiny Codes win and lose they will be thwarted.

If the Destiny Code is valid, the program will then read a history file at block 116. In this history file will be information as to the number of times the Game Medium was played, information about how many times this particular player has played, information about different habits that this player has during play, and general information as to what has transpired during the game. The serial numbers of the computer's BIOS from the different computers that the Game Medium was used will be stored so when a winner comes to claim a prize, the gaming authorities could process that disk and see how many different computers the disk was played on and then check for fraud. The history file will be used to check for security. The history file can also be used for the player to display their wins and losses so the player can keep track for tax purposes.

Block 118 is a decision block identified as "game encrypted because lotto was played". To increase sales, a lottery operator may wish to have the games run only once. If this is the case, after the lotto game is played the Game Medium is rendered unusable through encryption. The status of the game at that point is checked. If the game is a winner, a screen will be displayed that shows it is a winner. If the game is a loser, the final results will be displayed and the player cannot play that game again. This is a security measure. If the game has been encrypted, then the path will display an error at block 120 along with the final status of the game. The game cannot be played anymore and the program exits at block 122. If the game has not been encrypted, that means that this is the first time the game has been played or the game has not been completed.

Block 124 displays the "Introduction Screen Directions, Video Music And Credits". This would be the main welcome screen. At this point, the program will display information, including, for example, a video describing the different games that are available. The video may include scenes of the old west or a space theme. If the game is a puzzle, elements of the puzzle would be described. The program will wait for a key to be pressed or some button to be pressed at block 126. As soon as the key is pressed, the program proceeds to block 128 to display the main Game Menu and to allow for game selection. The menu could be in the form of a picture of a street, a horse track and race field, a casino, and a lottery redemption center. Games including horses, block 130; Play 21, block 134; and Play Lotto, block 132, are for illustration purposes and are just examples of a few types of games that can be used with the present invention.

At this point in the game, the player can be brought into the game. Displays can illustrate a city with a road map or the actual visuals that the player can click to get to different places. The player can play the game like an interactive adventure game. The ultimate extreme allows the player to actually play the game and get involved in the game. If the game is a murder mystery of some type, the player may find clues and then play Sherlock Holmes, once the player solves the crime, the player would win Fictitious Awards that allow him to gain additional Fictitious chances for the lotto drawing at the end of this game.

Figure 8:
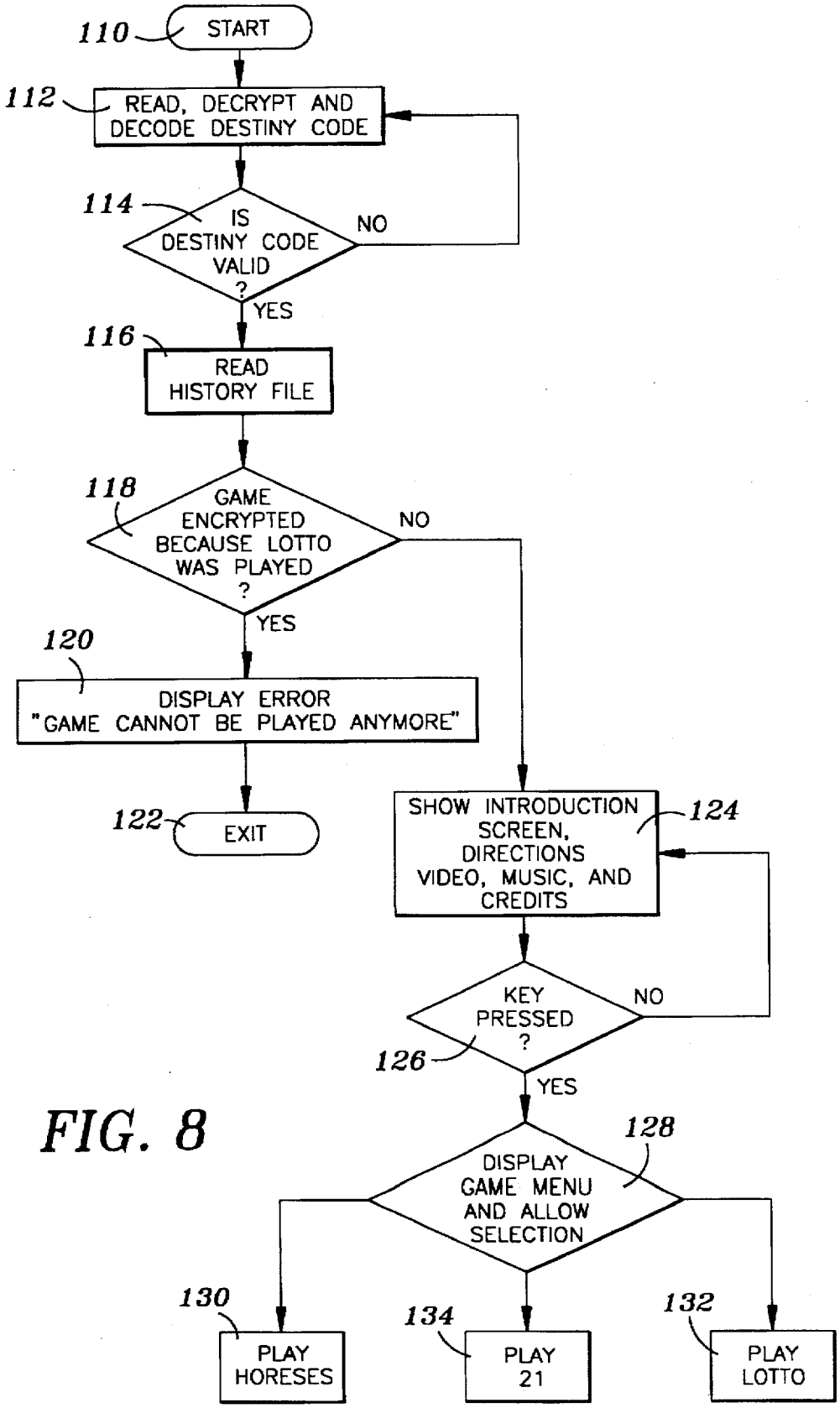
FIGS. 8–13 are computer flow diagrams illustrating the present software.
Figure 9:
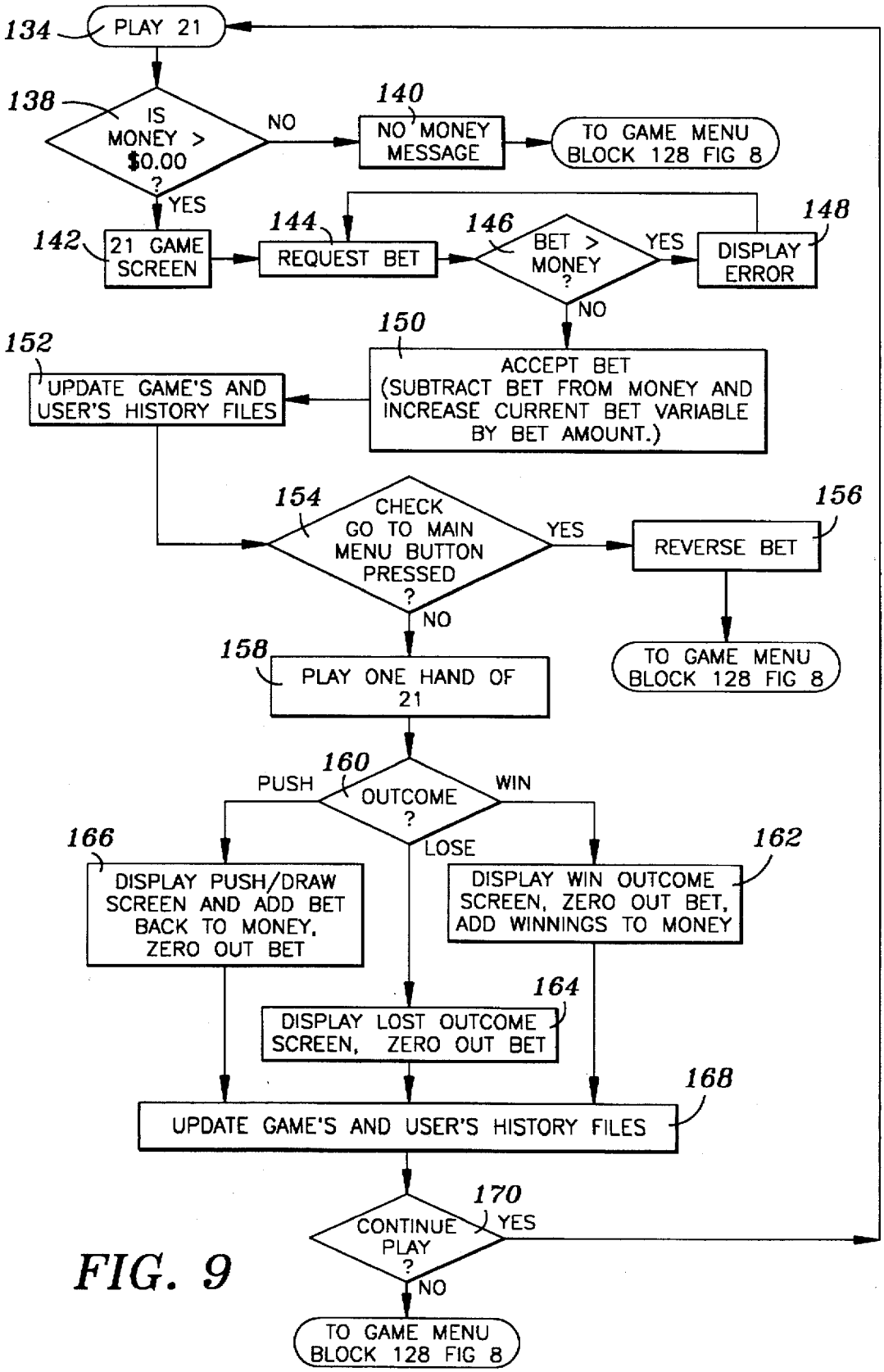

Referring to FIG. 9, if the player selects the Play 21 game, block 134 (FIG. 8), the program will check at block 138 to see if the player has money. If the player has more than zero dollars, then the player can continue with the game. If the player does not have any money, the program will display a no money message at block 140 and the player will go back to the display game menu, block 128 (FIG. 8).

If the player has more than zero dollars, the 21 game screen is displayed at block 142. The 21 game screen can display a dealer, in progress with a person watching as in a casino in the year 1995, or if the game is based on an old west casino theme, the display could include music playing in the background, and girls dancing on a stage with a dirty old cowboy dealing.

After the 21 Game screen is displayed, the program requests a bet at block 144. The player places a wager. At block 146, a decision is made; if the bet is greater than the money the player has, an error is displayed at block 148 and another bet is requested. If the bet is less than the money that the player has, the bet is accepted at block 150, and an operation performed to subtract the bet amount from the money variable (the money the player has) and to increase the bet variable by the bet amount. For example, if the player has $10 in his money variable, and he makes a $5 bet, the bet variable would increase by $5 and the money would decrease from $10 to $5.

At block 152, the system and player history files are updated. The history file is a detailed security file. The player's history file will have information about playing statistics; for example, how many hands the player won and how many hands the player lost. The game's history file will have more detailed information, for instance, if the program was terminated by a debugging program or modified by some type of non-standard means, and it will keep track of these incidences to help ferret out fraud.

At block 154, a decision is made to determine if the main menu button was pressed. The player may begin a hand and may decide that before the hand is dealt he wants to go back to the main menu. If the player gets to that point and places the bet, the player can click the "Go To Main Menu" button at the bottom of the screen. At that point the program will reverse his bet block 156, for example, take $5 out of the bet variable and add it to the money variable. This will return the program back to block 128 (FIG. 8).

If the player did not press the "Go To Main Menu" button, block 154, he will then play one hand of 21 at block 158. The program can flow as follows. The program deals cards. The house will be the computer in this game. The player will play against the computer.

If the outcome at block 160 is that the player won, then the winnings get added to the money variable at block 162, so if the player hand is a 10 and a Jack, and the dealer has a 10 and a 7 the player wins. The $10 winnings would be added to the money variable and the bet variable would be zeroed out.

If the player loses at block 164, then the bet variable is zeroed out and the house's winnings are increased by $5. If the hand results in a push at block 166, meaning that both the player and the house had the same hand and the dealer could not take another card, for example both have a 10 and an 8, then the bet is added back to the players money account and no gain or loss is incurred.

The history file is updated at block 168. The player can then decide to continue play again at block 170 or return to the main menu, block 128 (FIG. 8).

Figure 10:
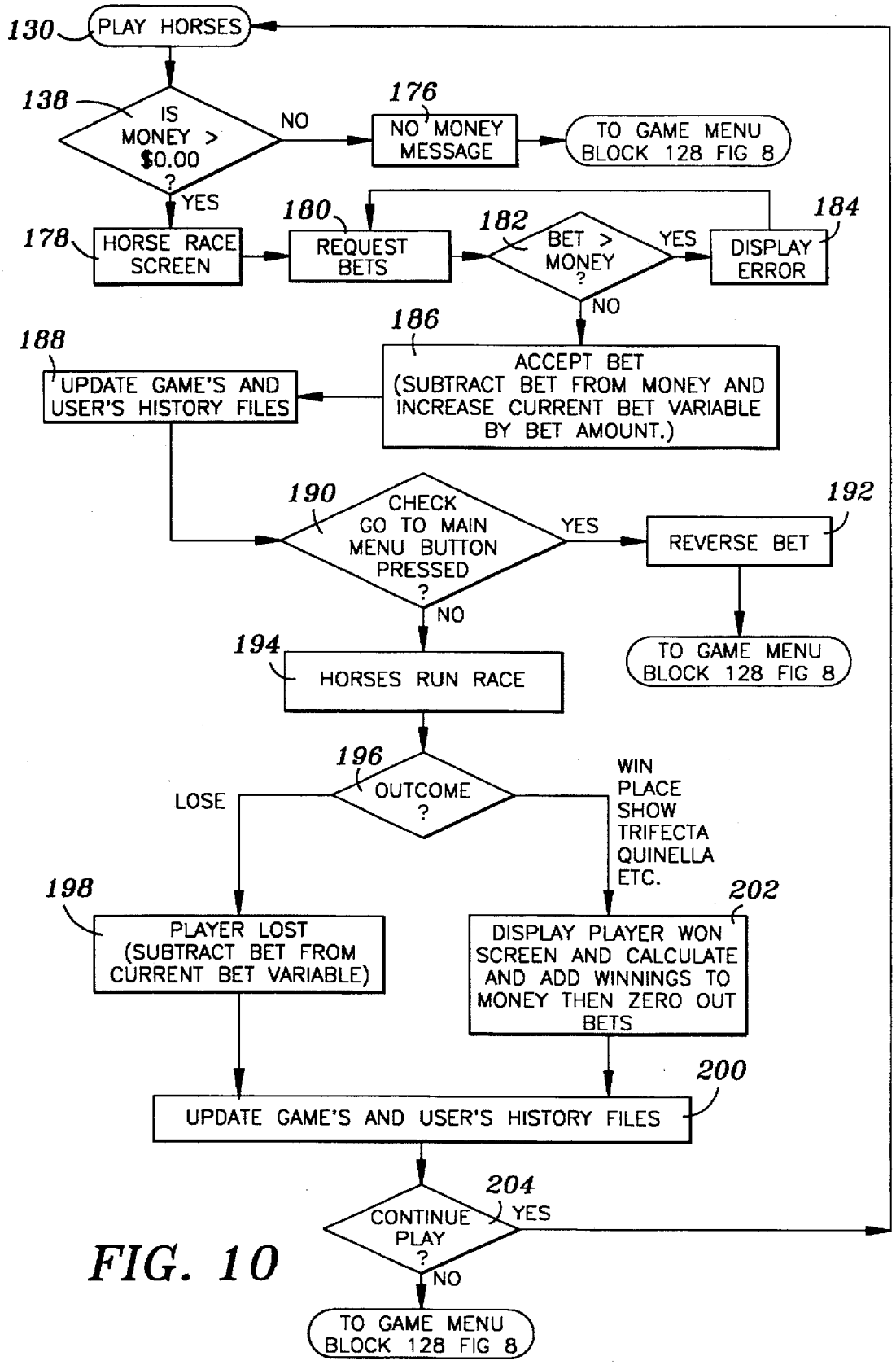

Referring to FIG. 10, the program for the play horses block 130 (FIG. 8) is illustrated. At block 174, the system checks to see if the player has more money than zero dollars. If the money variable is not greater than zero, block 176 displays a message and the player continues to the game menu block 128 (FIG. 8). If the player's money variable is greater than zero, the Horse Race screen is displayed at block 178 and a bet is requested at block 180. If the bet is greater than the money available, determined at block 182, an error will be displayed at block 184 and another bet will be requested. If the bet is not greater than the money available, the bet will be accepted at block 186 and then subtracted from the money variable and then added to the bet variable. If the player has $100 and bets $10 on horse #2, the amount bet on horse #2 is increased by $10.

The history file and the player's history file are updated at block 188.

At block 190, the "Go To Main Menu" button status is checked. If the button is pressed, the bet will be reversed at block 192 and the player will return to the game menu at block 128 (FIG. 8).

If the main menu button is not pressed, the horse race is run at block 194 and the outcome is displayed at block 196. The display of the race at block 194 can show actual video of horses or a computer animated screen. The player could even play a jockey and run the race.

If the player loses, the bet is subtracted at block 198 and the history file and the player's history file are updated at block 200. If the player wins, the winnings are calculated at block 202. At block 204, the player can continue play or return to game menu block 128 (FIG. 8).

Figure 11:
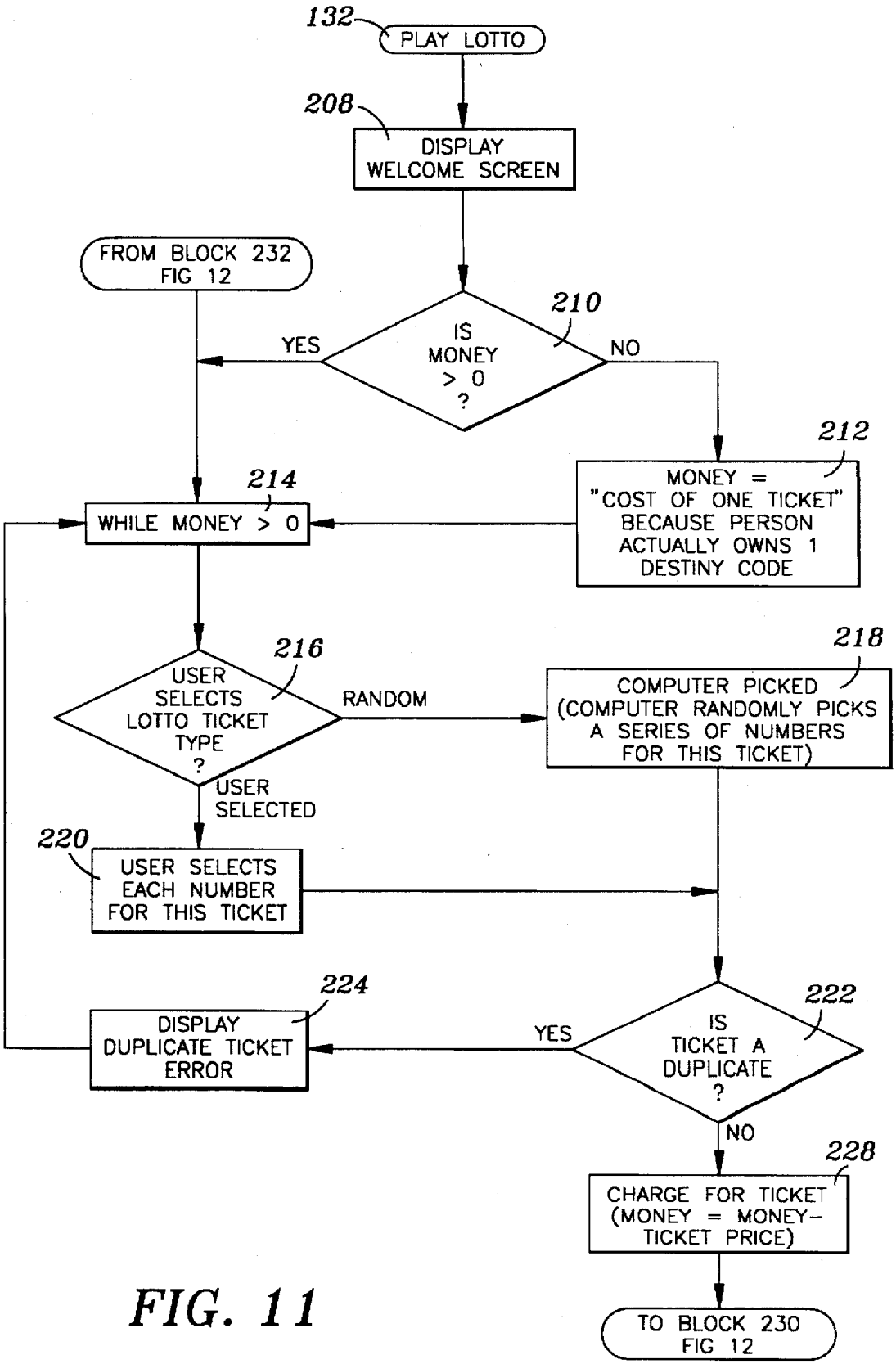
Figure 12:
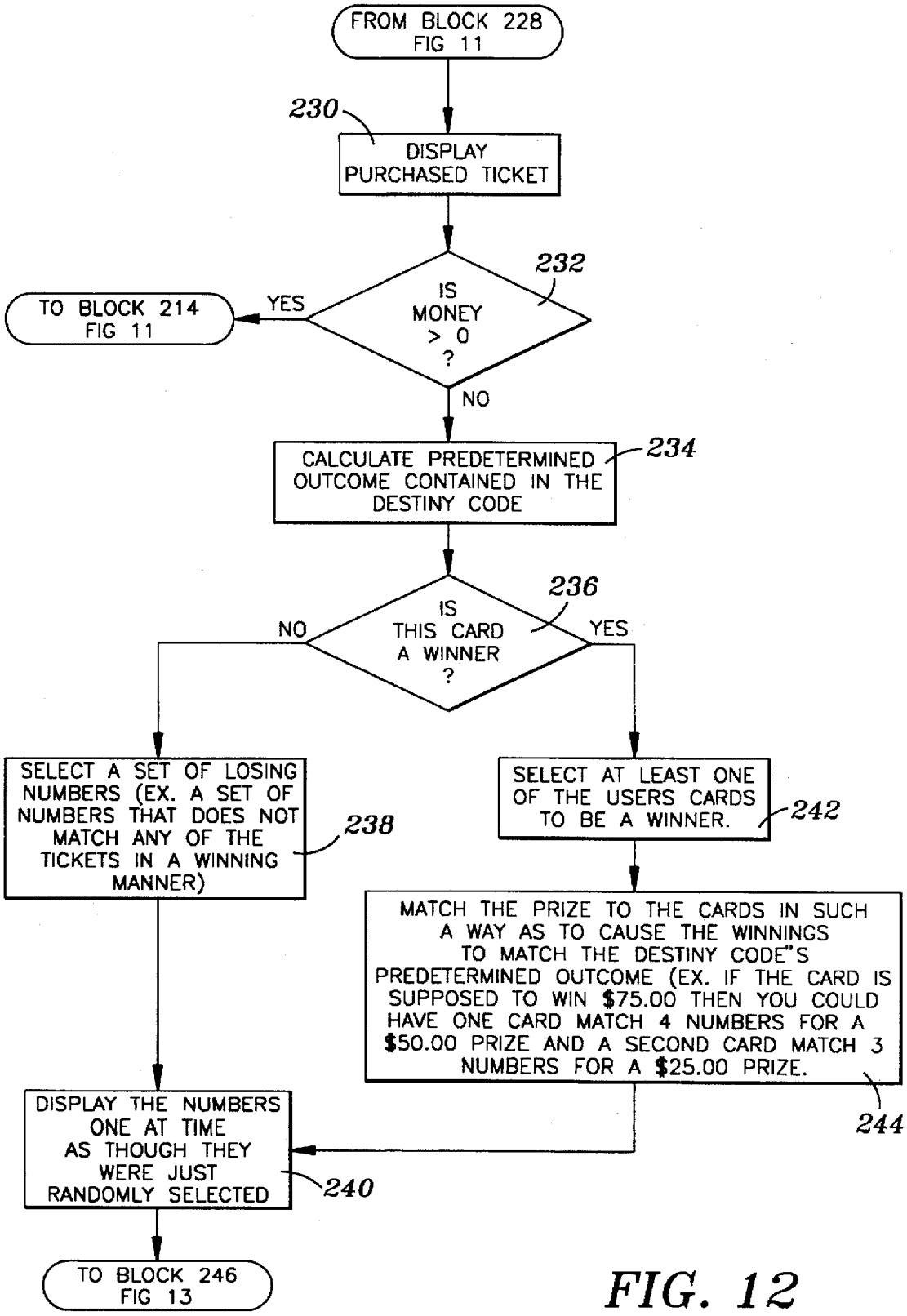
Figure 13:
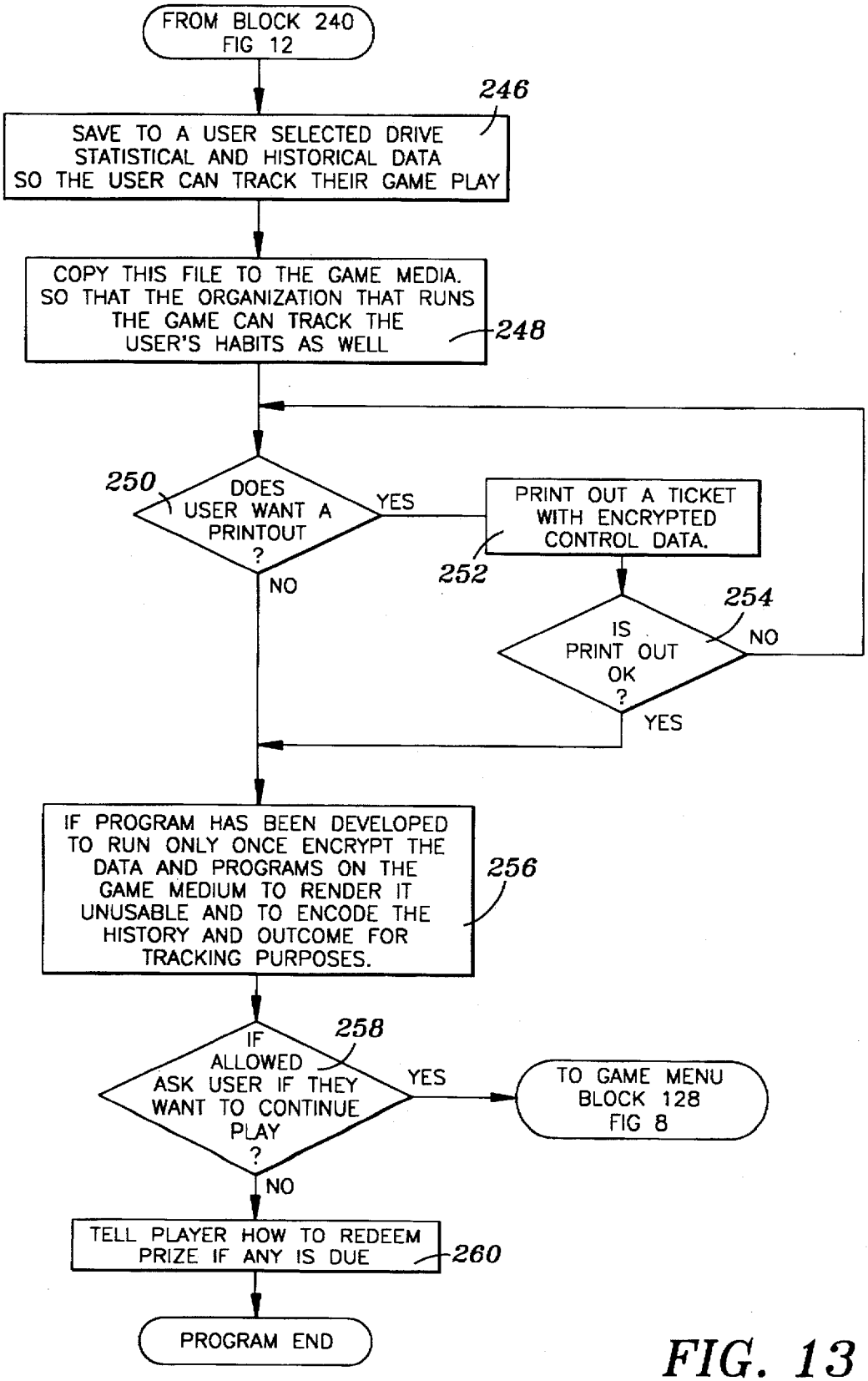

Referring simultaneously to FIGS. 11, 12, and 13, a third game, Play Lotto, block 132 (FIG. 8), is illustrated for use with the present invention. A welcome screen is displayed at block 208. The system checks to see if the player's money variable contains greater than zero dollars at block 210. If the money variable does not contain more than the price of a single lotto ticket, the system will give the player the price of a single lotto ticket or any predetermined amount at block 212.

At block 214, the system checks to determine if the money variable is greater than zero to determine if the purchase of more lotto tickets is possible. There are methods in which you can purchase lottery tickets. At decision block 216, the player selects either a random pick ticket, in which the computer selects at block 218 all of the lotto numbers for the player, or the player can select numbers at block 220.

At block 222, a check is made to determine if this ticket is a duplicate. If the ticket is a duplicate, a duplicate ticket error is displayed at block 224 and the program returns to block 214. For the random ticket, if a duplicate ticket is determined, the computer re-selects a number until no duplicate is selected. If this ticket is not a duplicate at block 228, a charge for the ticket is made by decreasing the money variable by the cost of the ticket.

Referring to FIG. 12, the system will then display the purchased ticket at block 230. A decision is made at block 232 to determine if money variable contains more than zero dollars. If the money variable does, the program returns to block 214 (FIG. 11) and the program continues purchasing tickets until the player has used all dollars in the money variable.

The program calculates its predetermined outcome at block 234 using the Destiny Code that has already been decrypted and decoded at block 112 (FIG. 8). The outcome may be determined, for example, by comparing the Destiny Code to a lookup table to determine if the number is a loser or a winner and the size of the prize, if any. For example, if the series of digits in the Destiny Code indicates that the game is a $75 winner, then the system will set up a winning lotto drawing.

The decision is made at block 236. If the card is not a winner, then the computer will randomly select a set of losing numbers at block 238. The computer will select a set of numbers randomly, and then check to see if any of the cards match that set of numbers in a winning manner. If none of the cards match in a winning manner, that set of numbers will be displayed at block 240 in an exciting and interesting lotto like display. The set of numbers could be displayed by spinning a wheel or by picking a ball from an air filled Lucite cage. This will give the appearance of randomness even though the outcome was predetermined at the time the Destiny Code was created.

If this card is a winner, then the system will select at least one of the lottery tickets to be the winner at block 242.

At block 244, the system will take into consideration the payout schedules when making the winning number selection. For example, if the Destiny Code contains a $75 winner, the computer can let one lotto ticket win $75.00 or 3 lotto tickets, win $25 each, if the player has three lotto tickets. This is the main reason for not allowing duplicate tickets. If a player had $11, and selected 11 of the same tickets and this card was a winner, there might not be a pleasing way to award a $75 prize out of 11 different tickets that have the same sequence of numbers on them. The reason that a player is given one ticket, is because if the card is a winner, the program must have at least one lotto ticket to show the outcome of the Destiny Code. Block 240 now displays the numbers one at a time as though they were just randomly selected.

Referring to FIG. 13, at block 246, the program saves the player's statistical and historical data to a player selected location so the player can track his game play. At block 248, this file is copied to the Game Medium so that the organization that runs the game can track the player's habits as well.

A standard format can be used, for example, on the player's computer one PC file can track the history of every game played. This file can be copied to the Game Medium to develop a complete historical makeup of the different things that this player has been doing and this information can be used for marketing and security purposes.

Block 250 allows the player to print out the results of the game and other statistics. If a printout is desired, at block 252 a ticket with encrypted control data is printed. Inquiry is made at block 254 to ensure the ticket has printed properly. If the game is designed to run only once, the Game Medium is encrypted at block 256. At block 258, a decision by the player is made to end the game or return to the game menu, block 128 (FIG. 8).

If the player decides to end game, a screen will be displayed that tells the player how to redeem his prize, if any is due.

Game Medium is brought to a redemption center. The redemption center processes the Destiny Code and awards any prizes that are due.

Figure 14:
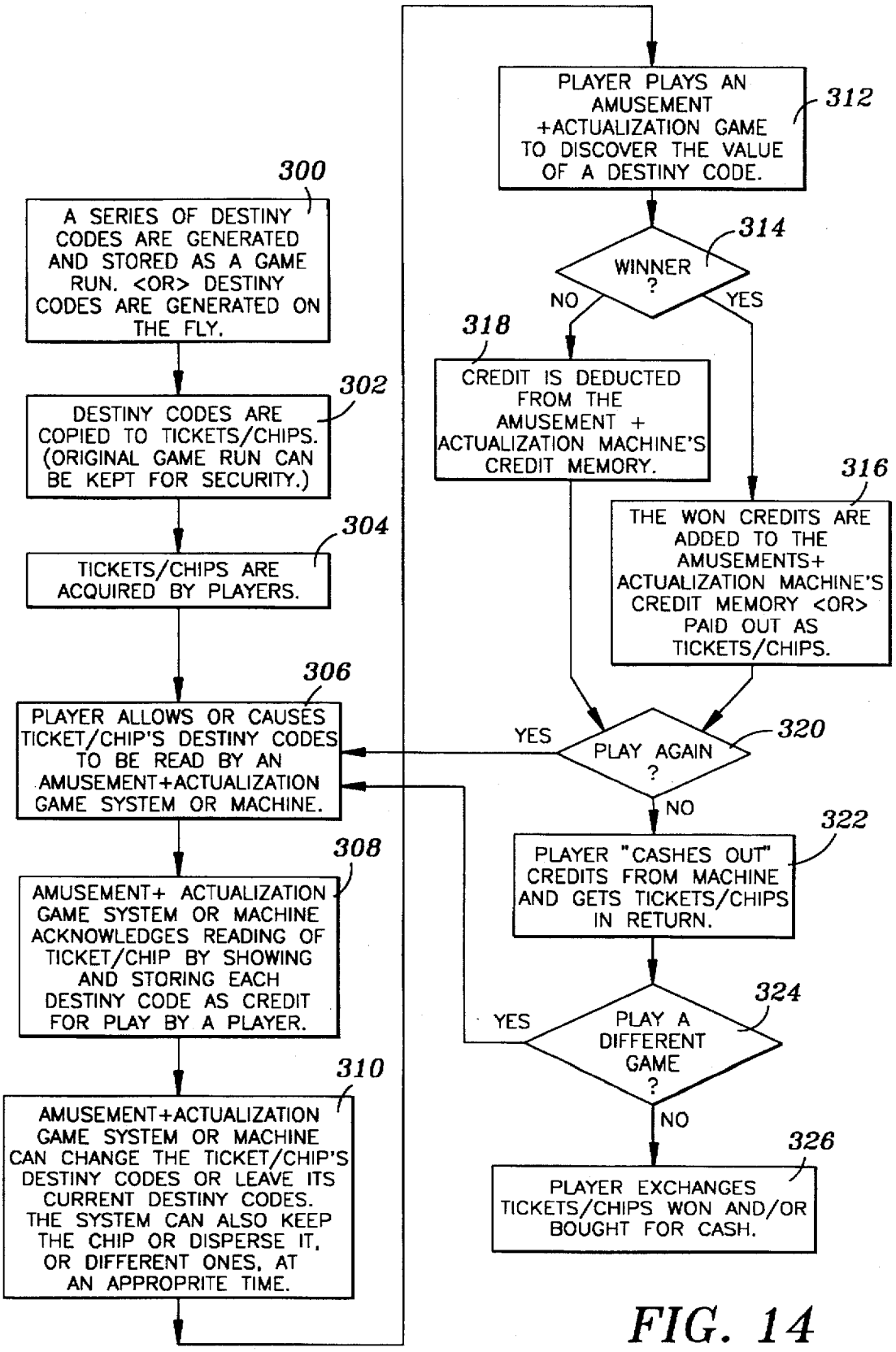
FIG. 14 is a block diagram of the basic steps for use of the present Game Medium.

Referring now to FIG. 14, the present method will now be described with respect to using gaming pieces in the form of casino chips or tokens containing Destiny Codes to allow a player to simulate wagering games with cash. A series of Destiny Codes are generated at step 300 based upon a specification set by an operator. These Destiny Codes can be created at a single time, and then stored in an inventory of Destiny Codes, or the Codes can be created on the fly. If the Destiny Codes are generated at a single time, the operator has control over the lottery game's odds and would be able to determine the profit from a full game in the event that all Destiny Codes were sold.

If the Destiny Codes are generated one at a time by an operator, the operator can adjust the odds of winning the lottery game by setting certain parameters or by allowing the present system to operate randomly. Both such systems have advantages. The system that uses parameters would allow for a set number of winners or a set number or value of prizes. Before the actual Destiny Codes would be established, the system could check to determine if a maximum prize to give away amount has been exceeded. If the maximum prize has been exceeded, the system would generate non-winning Destiny Codes. If the maximum prize had not yet been awarded, the system would randomly generate winning or non-winning Destiny Codes. The game operator would control the value of the prizes to be awarded, but would not know which gaming piece contained winning Destiny Codes. This system requires re-initialization so that all prizes could be available again. Alternatively, the system could make new prizes available based upon some outside event, for example, the passing of a certain number of days, or the reaching of a certain level of game piece ticket sales.

An additional way to accomplish prize control is to set the odds of winning specific prizes and then allow the system to randomly generate Destiny Codes, each with the same set of odds. For example, if the odds of winning the top prize are 1 in 25,000, and to win the top prize a match of a specific number, like 15,000 is required, the computer could randomly select a number between 1 and 25,000, and if the selected number equals 15,000, a grand prize winning Destiny Code would be generated. This system provides the advantage that any player can win, and there is no limit to the Destiny Codes that can be created.

Referring again to FIG. 14, once created, the Destiny Codes are sorted, stored, and copied at step 302 onto write-once or write-many tickets/tokens. This storage is done in a fashion that precludes players and gaming personnel from knowing which gaming piece has which value. One method of storing Destiny Codes is utilizing an integrated circuit memory which will subsequently be described with respect to FIG. 15.

The gaming pieces are distributed and acquired by players at step 304. At step 306, the present amusement+actualization system accepts the gaming pieces from a player. This acceptance may be in the form of insertion of a gaming piece into a receptacle, such as present in a conventional slot machine. At step 306, the amusement+actualization game system reads the Destiny Code contained on the gaming piece. The reading operation takes place by a processor which reads the Destiny Code stored in the memory device contained on the gaming piece.

At step 308, once the Destiny Code has been read and verified, the system acknowledges the reading of a valid Destiny Code by displaying a credit for play by a player. At step 310, the system can either change the Destiny Code stored on the Game Media, or leave the Destiny Code read by the system. The system can also retain the gaming piece to be dispersed randomly at a later time or disperse the gaming piece with a new Destiny Code or the same Destiny Code with a new value.

At step 312, the game player then plays the amusement game to discover the actual value of the gaming piece. The player has the option to select the amusement game to be played, or the gaming piece or system may determine the type of amusement game to be played. The system can randomly select an amusement game to be played, or each token gaming piece may include a code that allows the gaming piece to be played with a unique type of amusement game. For example, a gaming piece can act as a coin as a player selects a game to play, for example, video poker, keno, or bingo. This selection aspect of the present invention will be subsequently described with respect to FIG. 16. The gaming piece may also act like an admission token to allow a player to play a single game like bingo.

Figure 15:
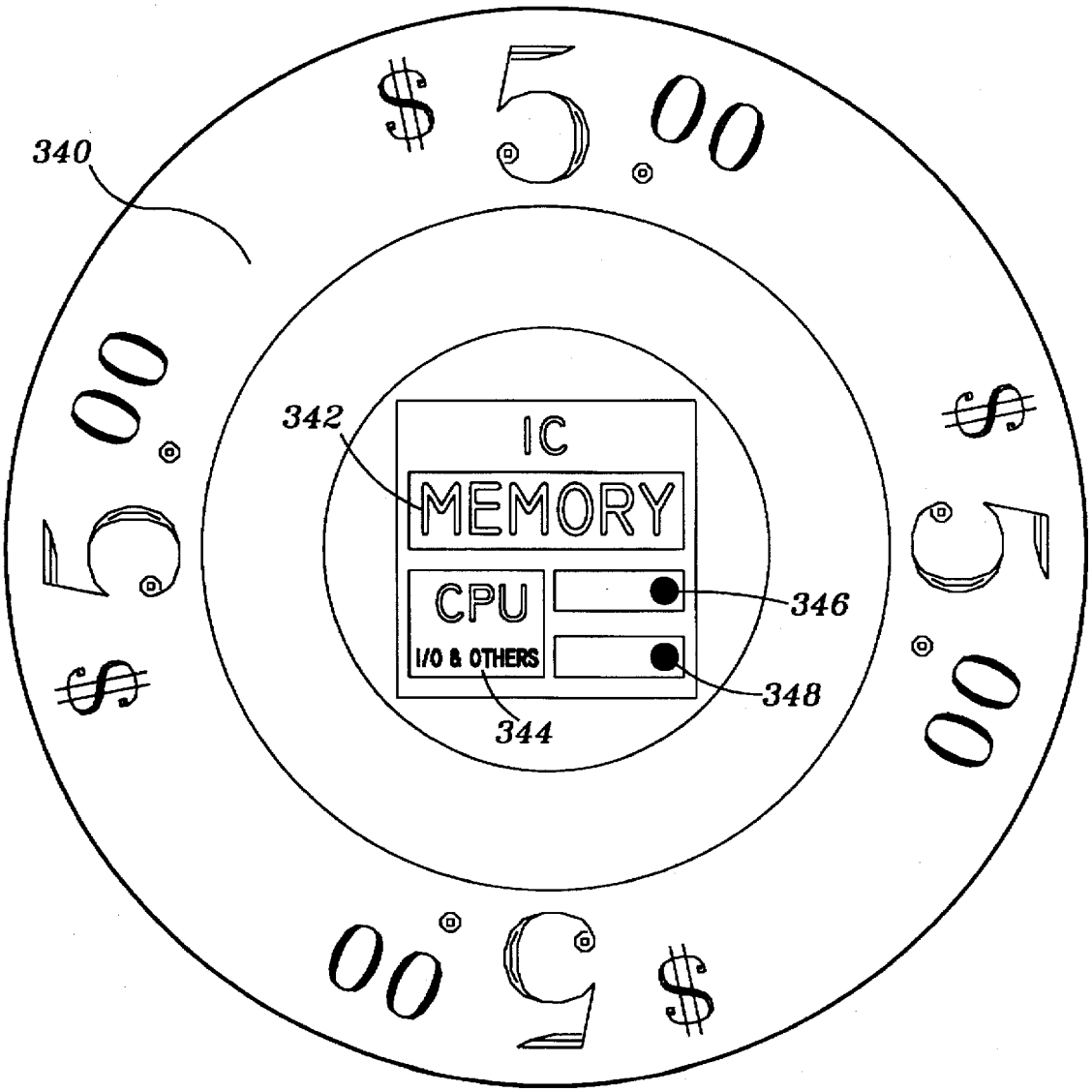
FIG. 15 is an enlarged plan view of a gaming piece for use with the present invention.

Once a gaming piece Destiny Code is read by the amusement+actualization game processor at step 310, the system copies the Destiny Codes from the gaming piece and can replace those copied Destiny Codes with new Destiny Codes, or simply place the gaming piece into a hopper so that the gaming piece can be randomly distributed at a later time. The amusement+actualization game now shows a credit equal to the value of the gaming piece denomination. For example, as illustrated in FIG. 15, if a gaming piece is a $5.00 token with a denomination value of $1.00, the system will show five credits. If the $5.00 token has a denomination value of $0.25, the system will show twenty credits. Alternatively, a token can store both and use the appropriate denomination where necessary.

During play of the amusement game at step 312, the system functions like a standard coin operated video or amusement game. Player credits are controlled by the Destiny Code which control the outcome of the amusement game. As previously described with respect to FIGS. 1–13, the player does not realize that the outcome of the game is controlled by the Destiny Code and not player actions. The player, however, will believe that the gaming pieces operate like cash or coins because the system accepts such gaming pieces in an analogous manner to coins. The player will play each credit and can win or lose more credits. The credits are symbols for and represent the number of Destiny Codes owned or controlled by the game player.

At step 314, a decision is made at the conclusion of playing the amusement game whether the player is a winner or loser. If the player is a winner, at step 316, the system will increase the player's credits by the amount won, and will set aside new Destiny Codes for the player. If the player is not a winner, at step 318, the system will place the Destiny Codes into a Destiny Code prize pool, stored within the system or written directly onto gaming pieces if the tokens are designated write-many. If the Destiny Code is a non-winning code, at step 318, a credit will be deducted from the player's credits and the Destiny Code will be moved to the Destiny Code inventory and/or the gaming piece will be dropped into a hopper for random distribution at a later time. It is preferred that the gaming piece's value or Destiny Code is changed so that players cannot subsequently identify winning and non-winning gaming pieces.

At step 320, the player determines whether the player wishes to play the amusement game again with increased or decreased credits and the system returns to step 306. If the player decides against playing again, the player can "cash out" and be given gaming pieces that have the same number of Destiny Codes and/or credits at the time of cash out at step 322. The player can now select a new game at step 324 and return to step 306 or alternatively, the player can exchange the gaming pieces for cash at step 326.

FIG. 15 illustrates an embodiment of a gaming piece of the present invention, generally identified by the numeral 340 in the form of casino chip. Gaming piece 340 includes indicia indicating a token value, such as for example, $5.00. Included on gaming piece 340 is an integrated circuit memory device 342 which stores Destiny Codes. Integrated circuit memory device 342 is selectively programmable to store multiple Destiny Codes, and is electronically erasable to store new Destiny Codes and may include, for example, a random access memory device. Integrated circuit 342 may also include a processor 344 for accessing, securing and reading Destiny Codes stored in memory 342. Terminals 346 and 348 interconnect memory 342 to the present system for reading and programming Destiny Codes into memory 342, and can be read from any angle and on either side. It therefore can be seen that gaming piece 340 simulates the play of a casino type slot machine utilizing tokens or coins.

Figure 16:
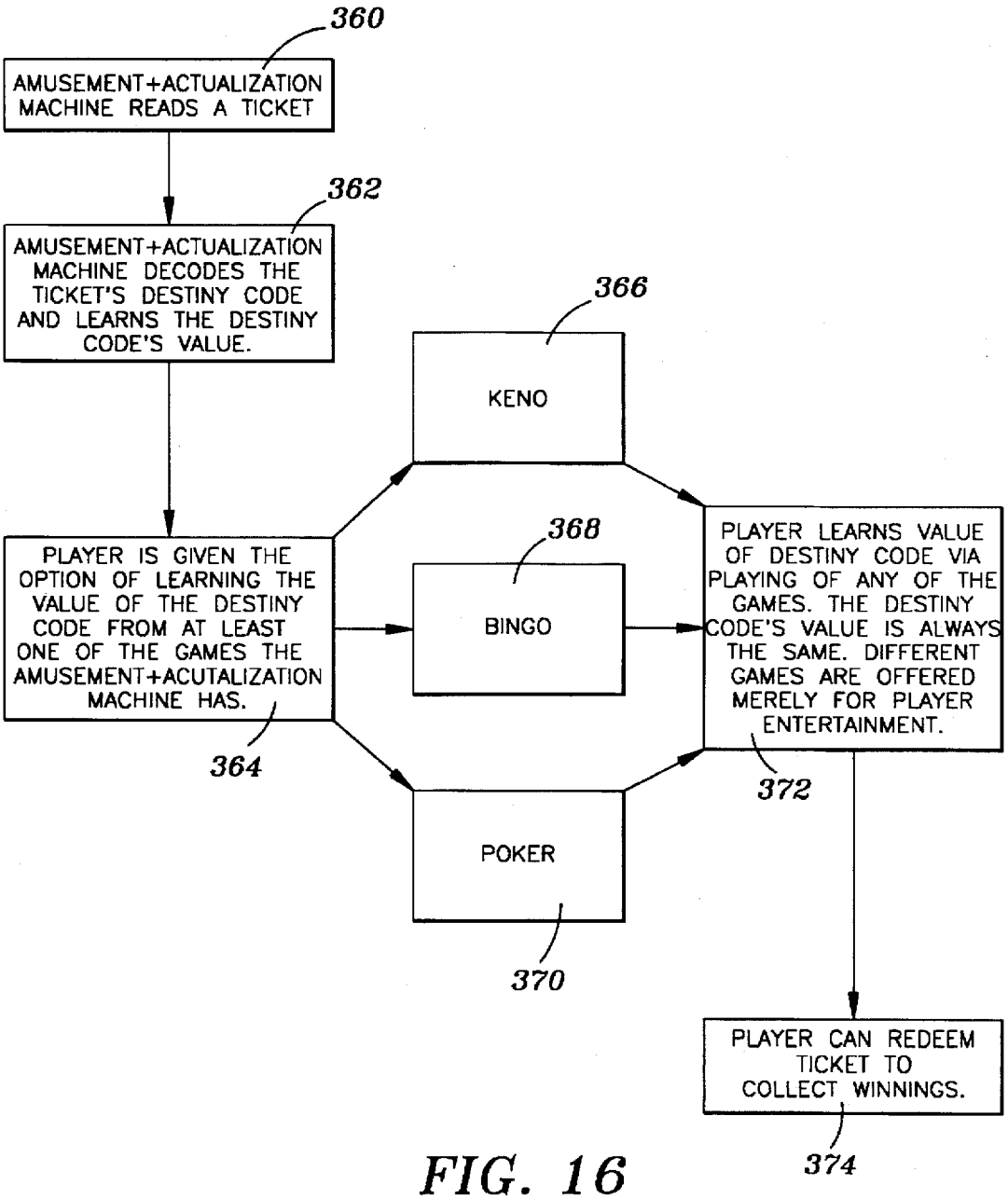
FIG. 16 is a block diagram of the multiple games embodiment of the present invention.

Referring now to FIG. 16, an embodiment of the present invention in which a player has an option of playing one or multiple different amusement games will now be described. At step 360, the amusement+actualization gaming system reads a gaming piece. At step 362, the system decodes the gaming piece's Destiny Codes to learn the gaming piece's value. The system now knows whether the player will win or lose the lottery type game, as well as whether the player will win or lose the amusement game to be played by the player. The player now has the ability to select the type of amusement game to be played in order to learn the value of the gaming piece, controlled by the Destiny Code.

At step 364, a game player is given the option to select the amusement game or games to be played. The player can select from one or more games such as, for example, keno at step 366, bingo at step 368, or poker at step 370. Fewer or more amusement games can be provided as an option to the player. Once play of the selected game has concluded, a player will learn of the outcome of the ticket's played Destiny Code at step 372. The system can write on the gaming piece a code which will indicate which Destiny Code has been played or the amusement+actualization system can store the Destiny Code for a period of time and not allow the Destiny Code to be replayed for a period of time. This action will stop players from trying to play a Destiny Code more than once. At step 374, the player can redeem the gaming piece to collect winnings.

Figure 17:
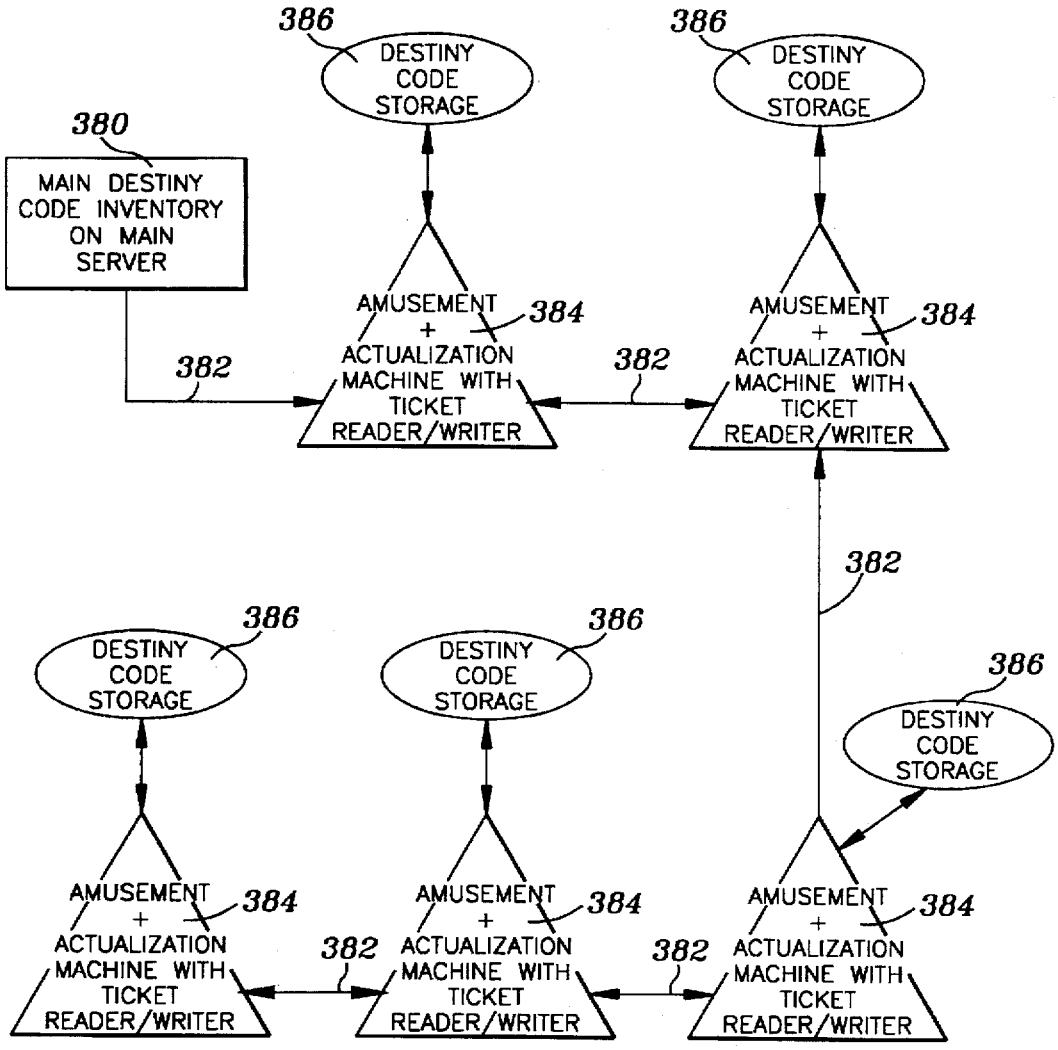
FIG. 17 is a block diagram of the network system of the present invention.

Referring now to FIG. 17, a network of gaming systems used to simulate cash with write-many gaming pieces is illustrated. A main computer 380 maintains Destiny Codes in an inventory. A network 382 allows multiple amusement+actualization systems 384, which receive gaming pieces from multiple players, to interact with main computer 380. Each amusement+actualization system 384 has an associated Destiny Code storage device 386. The network allows each amusement+actualization system to operate in real time, near real time, or allows the system to maintain a Destiny Code inventory to operate in a batch mode. Each amusement+actualization system receives Destiny Codes via a gaming piece in the form of a chip or token as describe with respect to FIG. 15. In the network system illustrated in FIG. 17, the system players will use gaming pieces that can be written to at least once, and the system will track players'wins and losses. Wins are stored by writing to the memory of a gaming piece new Destiny Codes, each symbolizing a credit, and losses are noted by erasing Destiny Codes from the memory of a gaming piece in which case the Destiny Code may be stored in an inventory for future use, security and accounting.

Figure 18:
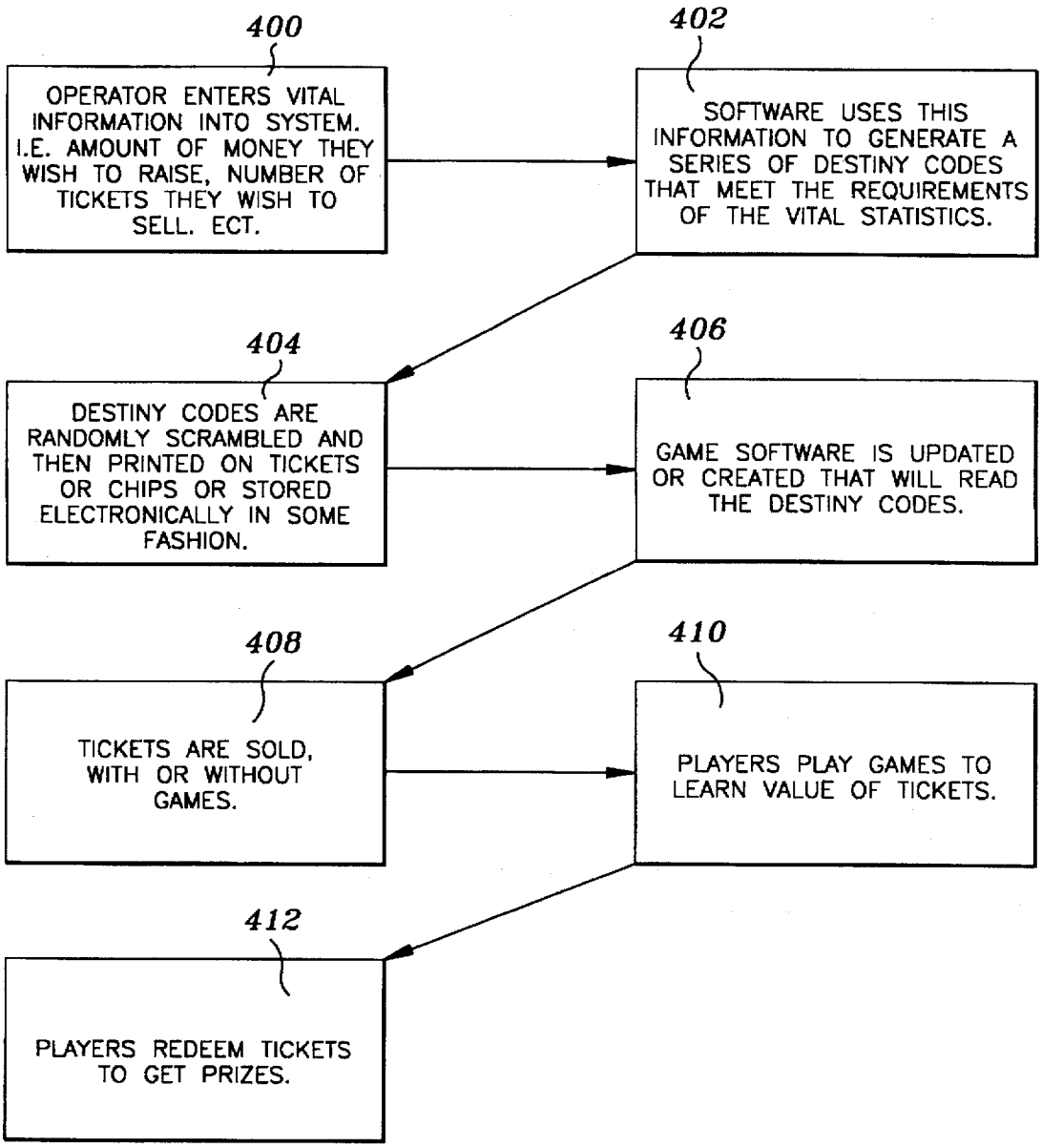
FIG. 18 is a block diagram of the fund raising embodiment of the present invention.

Referring now to FIG. 18, the present game for use in a fund raising system is illustrated. Many organizations wish to raise money through charitable gaming. Such gaming has been an accepted method to raise money; however, such a system may be costly. Utilizing the present system, a charitable organization can enter parameters at step 400, including, such as for example, the amount of money to be raised, and the number of gaming pieces to be sold. Utilizing these initial parameters, the system will generate a series of Destiny Codes to meet the requirements of the input parameters at step 402. For example, if the organization desired to raise $10,000, and wanted to sell gaming pieces for $1.00 each, parameters would generate a run of, for example, 20,000 Destiny Codes. The Destiny Codes would award $10,000 in prizes, leaving the charitable organization $10,000.

The Destiny Codes are randomly scrambled at step 404 and are printed on paper gaming pieces or coded electronically or magnetically on gaming pieces. Alternatively, the game operator may purchase 20,000 preprinted gaming pieces, and the system would assign winning and losing values to the preprinted Destiny Codes. Once the winning and non-winning Destiny Codes are calculated by the system at step 406, disks are created that are compatible with the preprinted or to be printed Destiny Codes. At step 408, the gaming pieces are sold to game players. Game pieces can be sold with the disk or without a disk. At step 410, purchasers of the gaming pieces can play the amusement game in their own home utilizing a personal computer or at the organized charity facility. Players redeem the gaming pieces to collect their winnings at step 412. The present system allows gaming pieces to be validated so that game players cannot forge a gaming piece. This system integrity can be performed by maintaining a series of security numbers along with Destiny Codes, and then requiring both to be entered. Entering the Destiny Code and the security number into the main computer that created the Destiny Codes at step 402 will increase security.

Using Destiny Codes on gaming pieces instead of cash makes the present system more secure against fraud and theft. Since the gaming pieces must be redeemed at a specific location where trained employees can examine the gaming pieces, security is maintained. The system can also function as a cash-less game. Since the gaming pieces are purchased at specific locations, all cash is handled at these specific locations. Establishments that allow cash and coins to be accepted by a machine which dispenses gaming pieces must spend time collecting cash and coins from these machines and/or adding cash and coins to these machines. The present system provides for the moving of Destiny Codes, but the cash is maintained at one secure location.

Because the present system is based on Destiny Codes, and because Destiny Codes can be generated in many different patterns, the system can be used to create lottery games as opposed to casino play. Lottery games require that each player play against other players and not the "house" or lottery game operator. Lottery games that use the present gaming pieces can provide more exciting games to players.

Because the player's winnings will be returned in the form of gaming pieces, a player will have a sense of excitement when a player wins, because the amusement+ actualization system can pay out gaming pieces in an exciting manner. A player could buy ten gaming pieces and if the player wins one hundred gaming pieces, the player will be able to see, feel and hear the additional gaming pieces being paid out simulating the operation of a conventional slot machine. This payout will provide an exciting and real opportunity to handle additional gaming pieces.

Figure 19:
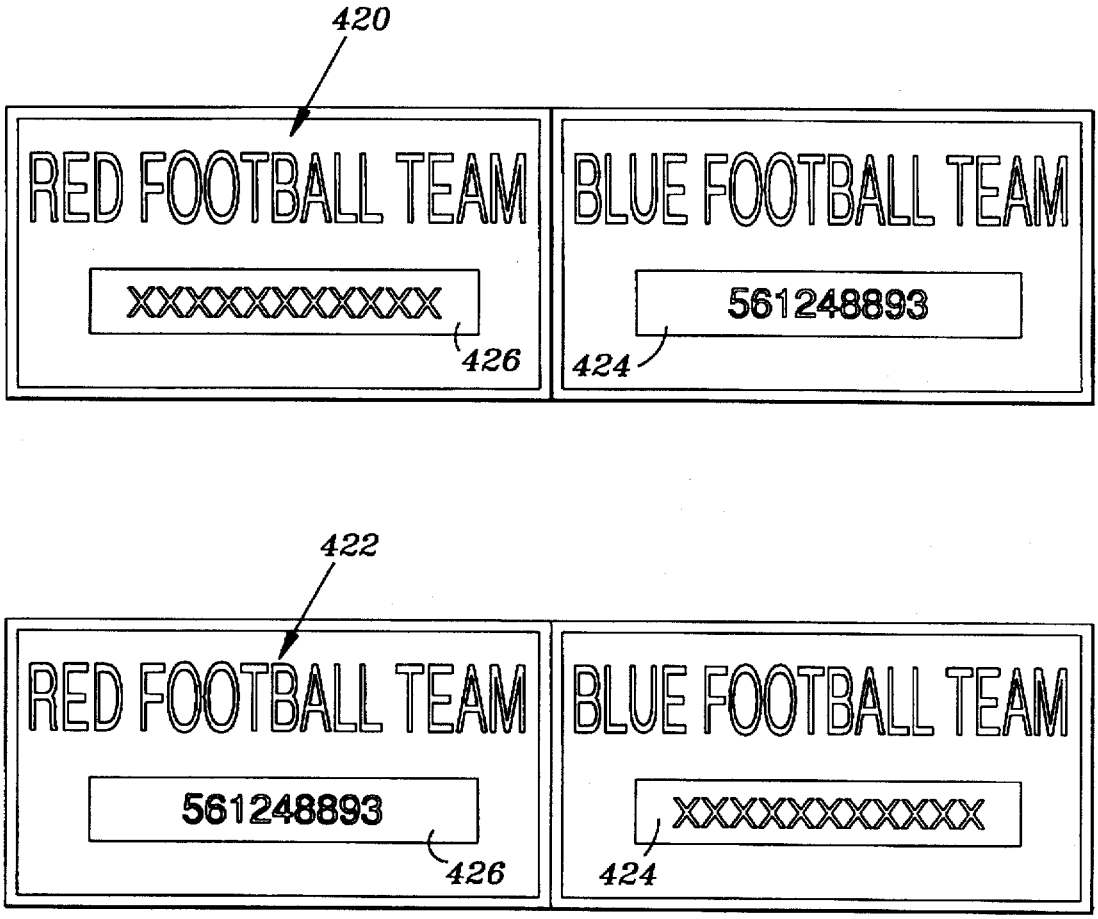
FIG. 19 is an illustration of an additional gaming piece for use with the present invention.

Referring now to FIG. 19, to further enhance the interest of the present lottery type and raffle type games, the gaming piece may be linked to an external event. Not only must a player have a winning gaming piece, the player must also select the winner of an external event, such as, for example, the winner of a football game. FIG. 19 illustrates gaming pieces 420 and 422. If a player purchases gaming piece 420, in order to win the player requires the winning Destiny Code as well as the blue team to win the football game. If the red team won on gaming piece 420, gaming piece 420 would be a losing game even if the Destiny Code was a winning number. When a player buys a gaming piece from a vendor, the player must inform the vendor of which team the player expects to win. If the player expects the blue team to win, the number to be played in the lottery type game or raffle type game will be printed in the area 424 of the blue team portion of gaming piece 420. Alternatively, the number can be erased from the area 426 of the red team portion of gaming piece 420.

Once the player purchases the gaming piece 420 or 422, the player can only win by receiving the correct winning Destiny Code and by selecting the correct outcome of the external event. The external event can be of any type, for example, sporting events, the selection of the best actor or movie award, or an event such as predicting the average temperature for geographical area. The type of event is irrelevant for use with the present lottery type game; the linking of the external event with the Destiny Code creates an exciting feature of the present invention.

Alternatively, the linking of the external event could increase or change the prize. So if a player had gaming piece 420 and this gaming piece held the winning number or Destiny Code, the gaming piece could win, for example, $1,000,000. But, if the gaming piece was a winner and the player selected the correct external link, for example, on gaming piece 420 the player selected BLUE TEAM and BLUE TEAM won, the prize could be changed or increased. So winning and selecting the correct team is worth $2,000,000.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. A method for playing a lottery type game comprising the steps of:

acquiring by a player a gaming piece, the gaming piece including a code which includes data indicating whether the player wins or loses the lottery type game and an amusement game, the data being unrecognizable to the player, such that the player does not know whether the player will win or lose the games prior to play of the amusement game;

reading the code by a processor;

the processor generating the amusement game on a display for play by the player;

the processor controlling whether the player will win or lose the amusement game based upon the code; and providing on the display an indication to the player of the amusement game win or game loss based upon the code.

2. The method of claim 1 wherein the gaming piece includes a programmable memory for storing the code.

3. The method of claim 1 and further including the step of the player inserting the gaming piece into a data reader for reading the code.

4. The method of claim 1 and further including the step of awarding gaming pieces to the player when the player wins the amusement game, the number of gaming pieces awarded being based upon the code.

5. A method for playing a lottery type game comprising the steps of:

acquiring by a player a gaming piece, the gaming piece including a code which includes data indicating whether the player wins or loses the lottery type game and an amusement game, the data being unrecognizable to the player, such that the player does not know whether the player will win or lose the games prior to play of the amusement game;

inserting the gaming piece into a data reader for reading the code;

inputting the code into a processor;

the processor generating a plurality of amusement games on a display for play by the player, the player selecting at least one of the plurality of amusement games for play by the player;

the processor controlling whether the player will win or lose the selected amusement game based upon the code; and providing on the display an indication to the player of the selected amusement game win or loss based upon the code.

6. The method of claim 5 wherein the gaming piece includes a programmable memory for storing the code.

7. A lottery type game comprising:

a gaming piece, said gaming piece including a programmable memory for storing a code which includes data indicating whether a player wins or loses the lottery type game and an amusement game, said data being unrecognizable to the player, such that the player does not know whether the player will win or lose the games prior to play of the amusement game;

a processor for reading said code from said memory prior to amusement game play;

said processor generating the amusement game on a display for play by the player;

said processor determining whether the player will win or lose the amusement game based upon said code; and said display providing an indication to the player of the amusement game win or loss based upon said code.

8. The lottery type game of claim 7 wherein said processor generates a plurality of amusement games.

9. A lottery type game comprising:

a plurality of gaming pieces, each of said gaming pieces including a programmable memory for storing a code which includes data indicating whether a player wins or loses the lottery type game and an amusement game, said data being unrecognizable to the player, such that the player does not know whether the player will win or lose the games prior to play of the amusement game;

input means for inputting codes into said programmable memory of said plurality of gaming pieces;

a processor for reading said codes from said memory;

said processor generating the amusement game on a display for play by the player;

said processor determining whether the player will win or lose the amusement game based upon said code; and said display providing an indication to the player of the amusement game win or loss based upon said code.

10. The lottery type game of claim 9 and further including means for controlling the number of winning codes stored in said programmable memory of said plurality of gaming pieces.

11. A lottery type game comprising:

a plurality of gaming pieces, each of said gaming pieces including a programmable memory for storing a code which include data indicating whether a player wins or loses the lottery type game and an amusement game, said data being unrecognizable to the player, such that the player does not know whether the player will win or lose the games prior to play of the amusement game;

a plurality of game terminals, each of said terminals including means for receiving gaming pieces and a display;

a processor at each of said terminals for reading said code from said memory of gaming pieces played at said terminals;

each of said processors generating the amusement game on said terminal display for play by the player;

each of said processors determining whether the player will win or lose the amusement game based upon said code; and each of said displays providing an indication to the player of the amusement game win or loss based upon said code.

12. The system of claim 11 and further including means for storing codes at each of said terminals.

13. The system of claim 11 and further including means for interconnecting said plurality of terminals and for transferring codes between said plurality of terminals.

14. A lottery type game comprising:

a gaming piece, said gaming piece including a predetermined code which includes data indicating whether a player wins or loses; and a processor for reading said code, the player winning or losing the lottery type game based upon said code and occurrence of an event external to operation of the lottery type game, such that the player does not know whether the player will win or lose the lottery type game until after the occurrence of the event.

15. The lottery type game of claim 14 wherein said event is controlled by the player.

16. The lottery type game of claim 14 wherein said event is not controlled by the player.

17. The lottery type game of claim 14 wherein said code indicates whether the player wins or loses an amusement game for play by the player, and said processor controls whether the player will win or lose the amusement game based upon said code.

* * * * *